US006781443B2

(12) United States Patent
Hamamoto et al.

(10) Patent No.: US 6,781,443 B2
(45) Date of Patent: Aug. 24, 2004

(54) POTENTIAL GENERATING CIRCUIT CAPABLE OF CORRECTLY CONTROLLING OUTPUT POTENTIAL

(75) Inventors: Takeshi Hamamoto, Hyogo (JP); Katsuyoshi Mitsui, Hyogo (JP)

(73) Assignee: Renesas Technology Corp., Tokyo (JP)

( * ) Notice: Subject to any disclaimer, the term of this patent is extended or adjusted under 35 U.S.C. 154(b) by 0 days.

(21) Appl. No.: 10/274,890

(22) Filed: Oct. 22, 2002

(65) Prior Publication Data

US 2003/0197551 A1 Oct. 23, 2003

(30) Foreign Application Priority Data

Apr. 17, 2002 (JP) ..... 2002-114516

(51) Int. Cl.[7] ..... G05F 1/10
(52) U.S. Cl. ..... 327/541; 327/540; 323/316

(56) References Cited

U.S. PATENT DOCUMENTS 4,585,955 A * 4/1986 Uchida ..... 327/541
4,613,810 A * 9/1986 Jablonski et al. ..... 323/271
5,936,455 A * 8/1999 Kobayashi et al. ..... 327/437
6,201,378 B1 * 3/2001 Eto et al. ..... 323/313
6,265,858 B1 * 7/2001 Park ..... 323/313
6,426,670 B1 * 7/2002 Tanaka ..... 327/541

FOREIGN PATENT DOCUMENTS

JP 05-325549 12/1993

* cited by examiner

*Primary Examiner*—Terry D. Cunningham
(74) *Attorney, Agent, or Firm*—McDermott Will & Emery LLP

(57) ABSTRACT

An internal power supply potential generating circuit includes: a control potential generating circuit having four MOS transistors connected in series between a node and a ground potential line, and controlling a pull-up transistor and a pull-down transistor in order that a potential at an output node coincides with a control potential; a monitor potential generating circuit having four MOS transistors connected in series between a prescribed node and a ground potential line, and generating a monitor potential; a potential dividing circuit generating a potential 1/2 times a reference potential; and a VCC1 generating circuit controlling a potential at the prescribed potential in order that the monitor potential becomes the reference potential. Therefore, an output potential can be controlled with correctness.

11 Claims, 18 Drawing Sheets

POTENTIAL GENERATING CIRCUIT CAPABLE OF CORRECTLY CONTROLLING OUTPUT POTENTIAL

BACKGROUND OF THE INVENTION

1. Field of the Invention

The present invention relates to a potential generating circuit, and particularly to a potential generating circuit charging and discharging an output node in order that a potential of the output node becomes a potential corresponding to a reference potential.

2. Description of the Background Art

With the purpose to reduce power consumption, there has been heretofore provided an internal power supply potential generating circuit for generating an internal power supply potential VO lower than an external power supply potential VCC0 in a semiconductor integrated circuit device.

FIG. 21 is a circuit diagram showing a configuration of such an internal power supply potential generating circuit. In FIG. 21, the internal power supply potential generating circuit includes: an operational amplifier 151; P-channel MOS transistors 152 to 154; and N-channel MOS transistors 155 to 157. Operational amplifier 151 constitutes a voltage follower and outputs a current so as to cause a potential VDDS at a node N151 to coincide with a reference potential VR0. MOS transistors 152, 155, 153 and 156 are connected in series between node N151 and a line at ground potential GND. MOS transistors 157 and 154 are connected in series between a line at external power supply potential VCC0 and the line at ground potential GND. The gates of N-channel MOS transistors 155 and 157 are both connected to the drain of N-channel MOS transistor 155, and the gates of P-channel MOS transistors 153 and 154 are both connected to the drain of P-channel MOS transistor 153. The gates of MOS transistors 152 and 156 are both connected to an output node N157 between MOS transistors 157 and 154. A potential appearing at node N157 is internal power supply potential VO.

Transistor parameters of MOS transistors 152, 155, 153 and 156 are set in order that a potential VC at a node N155 between MOS transistors 155 and 153 is VDDS/2=VR0/2 when internal power supply potential VO is VDDS/2=VR0/2. Furthermore, not only is a threshold voltage of N-channel MOS transistor 157 set to a value higher than that of N-channel MOS transistor 155, but a threshold voltage of P-channel MOS transistor 154 is also set to a value higher than that of P-channel MOS transistor 153 in order that no through current flows into the line at ground potential GND from the line at external power supply potential VCC0 through MOS transistors 157 and 154. With such setting, MOS transistors 157 and 154 are both non-conductive when output potential VO resides in a dead band E1 between a lower limit value VL=VR0/2−ΔV1 and an upper limit value VH=VR0/2+ΔV2.

FIG. 22 is a graph showing an operation of the internal power supply potential generating circuit shown in FIG. 21. In FIG. 22, a straight line E in FIG. 22 shows a relationship between output potential VO and a drive current I of the internal power supply potential generating circuit. MOS transistors 157 and 154 becomes non-conductive to cause drive current I to be zero when output potential VO resides in dead band E1. With internal power supply potential VO higher than upper limit VH, not only a resistance value of P-channel MOS transistor 152 becomes higher, but a resistance value of N-channel MOS transistor 156 also becomes lower to lower gate potentials of MOS transistors 157 and 154, to cause P-channel MOS transistor 154 to be conductive, to thereby cause a discharge current to flow and to lower internal power supply potential VO. With internal power supply potential VO lower than lower limit value VL, not only a resistance value of P-channel MOS transistor 152 become lower, but a resistance value of N-channel MOS transistor 96 also becomes higher, to raise gate potentials of MOS transistors 157 and 154, to cause N-channel MOS transistor 157 to be conductive, to thereby cause a charge current flow and to raise internal power supply potential VO. Therefore, internal power supply potential VO is held at a potential between lower limit value VL and upper limit value VH.

In such an internal power supply potential generating circuit, a necessity arises for setting a source-to-drain voltage Vsdp of P-channel MOS transistor 152, a threshold voltage Vthn of N-channel MOS transistor 155, a threshold voltage Vthp of P-channel MOS transistor 153 and a drain-to-source voltage Vdsn of N-channel MOS transistor 156 in order that VC=VDDS/2=VR0/2 when VO=VC.

With lower VDDS, miniaturized layout, constraint from other circuits, fluctuations in fabrication parameters and others, more of difficulty has become a reality in fabrication of MOS transistors in matching Vsdp, Vthn, Vthp and Vdsn with design values. A result ends up with generation of an error voltage ΔV between internal power supply potential VO and a target potential VR0/2 as shown in FIG. 23 without matching Vsdp, Vthn, Vthp and Vdsn with design values.

In a conventional internal power supply potential generating circuit, not only were threshold voltages of N-channel MOS transistors 155 and 157 adjusted, but threshold voltages of P-channel MOS transistors 153 and 154 were also adjusted to thereby set a width of dead band E1, whereas control of a width of dead band E1 has become harder by a tendency toward lower VDDS and other reasons.

SUMMARY OF THE INVENTION

It is, therefore, a main object of the present invention to provide a potential generating circuit capable of correctly controlling a potential at an output node.

It is another object of the present invention to provide a potential generating circuit capable of correctly controlling a dead band width.

A potential generating circuit according to the present invention, as described above, includes: a first transistor of a first conductive type, a first electrode of which is connected to a line at a first power supply potential, and a second electrode of which is connected to a output node; a second transistor of a second conductive type, a first electrode of which is connected to a line at a second power supply potential, and a second electrode of which is connected to the output node; a control potential generating circuit; a monitor potential generating circuit; and a current supply circuit. The control potential generating circuit includes: a third transistor of the second conductive type, a first electrode of which is connected to a first node, an input electrode of which is connected to the output node, and a second electrode of which is connected to an input electrode of the first transistor; a fourth transistor of the first conductive type, a first electrode of which is connected to the line at the second power supply potential, an input electrode of which is connected to the output node, and a second electrode of which is connected to an input electrode of the second transistor; and first and second diode elements connected in series between the second electrodes of the third and fourth transistors, wherein the first and second transistors are controlled in order that a potential at the output node coincides with a potential at a second node between the first and second diode elements. The monitor potential generating circuit includes: a fifth transistor of the second conductive type, a first electrode of which is connected to the first node and an input electrode of which is connected to a third node; a sixth transistor of the first conductive type, a first electrode of which is connected to the line at the second power supply potential, and an input electrode of which is connected to the third node; a third diode element connected between a second electrode of the fifth transistor and the third node; and a fourth diode element connected between the third node and a second electrode of the sixth transistor, wherein a monitor potential is outputted from the third node. The current supply circuit supplies a current to the first node in order that the monitor potential coincides with the reference potential. Therefore, when the monitor potential coincides with the reference potential, a potential at the second node takes the reference potential and a potential at the output node also further takes the reference potential. Accordingly, a potential at the output node can be caused to correctly coincide with the reference potential.

In another potential generating circuit according to the present invention, there are provided: a first comparison circuit; a second comparison circuit; and a drive circuit. The first comparison circuit includes: first and second transistors, input electrodes of which receive a reference potential and a potential at an output node, respectively, and outputs a first signal at a level corresponding to a potential difference between the potential at the output node and a lower limit potential lower than the reference potential by a first offset voltage. The second comparison circuit includes: third and fourth transistors, input electrodes of which receive the reference potential and the potential at the output node, respectively, and outputs a second signal at a level corresponding to a potential difference between the potential at the output node and an upper limit potential higher than the reference potential by a second offset voltage. The drive circuit operates in response to the first and second signals from the first and second comparison circuits, causing a current to flow into the output node when the potential at the output node is lower than the lower limit potential, while when the potential at the output node is higher than the lower limit potential, causing a current to flow out from the output node. Therefore, by setting a first offset voltage of the first comparison circuit, a lower limit potential can be set, and by setting a second offset voltage of the second comparison circuit, an upper limit potential can be set; and a dead band arises between the lower limit potential and the upper limit potential, thereby enabling setting of a width of the dead band with good precision.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
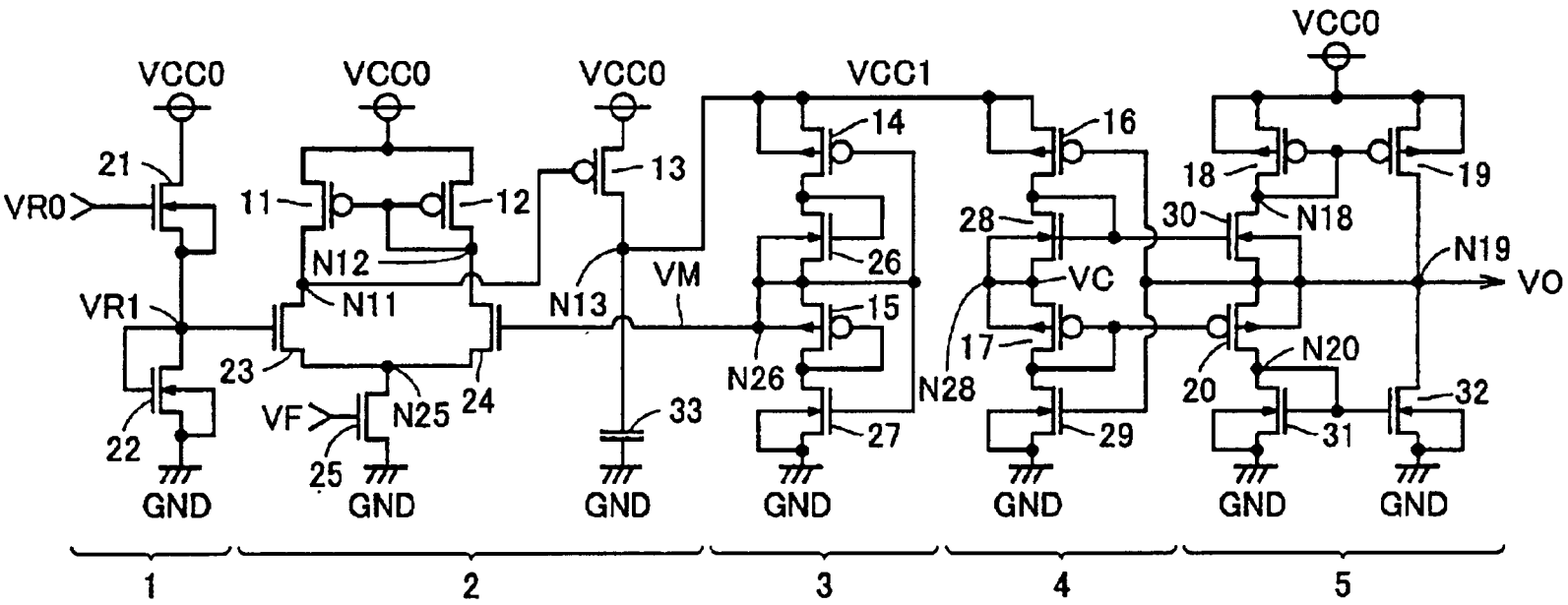
FIG. 1 is a circuit diagram showing a configuration of an internal power supply potential generating circuit according to a first embodiment of the present invention.

FIG. 1 is a circuit diagram showing a configuration of an internal power supply potential generating circuit according to a first embodiment of the present invention. In FIG. 1, the internal power supply potential generating circuit includes: a potential dividing circuit 1, a VCC1 generating circuit, a monitor potential generating circuit 3; a control potential generating circuit 4; and a drive circuit 5.

Potential dividing circuit 1 includes: N-channel MOS transistors 21 and 22 connected in series between a line at external power supply potential VCC0 and a line at ground potential GND. The gate of an N-channel MOS transistor 21 receives reference potential VR0. The gate of an N-channel MOS transistor 22 is connected to the drain thereof. The N-channel MOS transistor 22 constitutes a diode element. N-channel MOS transistors 21 and 22 are of the same transistor sizes (a channel width W and a channel length L) as each other. A potential VR1=VR0/2 1/2 times reference potential VR0 appears at a node between N-channel MOS transistors 21 and 22.

VCC1 generating circuit 2 includes: P-channel MOS transistors 11 to 13; N-channel MOS transistors 23 to 25; and a capacitor 33. P-channel MOS transistors 11 and 12 are connected between the line at external power supply potential VCC0 and a node N11, and between the line at external power supply potential VCC0 and a node N12, respectively and the gates of both are connected to node N12. P-channel MOS transistors 11 and 12 constitute a current mirror circuit. N-channel MOS transistors 23 and 24 are connected between node N11 and node N25, and between node N12 and node N25, respectively and the gates of both receives reference a voltage VR1 and a monitor potential VM, respectively.

A ratio W11/W12 of transistor sizes (ratio of channel widths) of P-channel MOS transistors 11 and 12 is equal to a ratio W23/W24 of transistor sizes of N-channel MOS transistors 23 and 24. N-channel MOS transistor 25 is connected between node N15 and the line at ground potential GND and the gate thereof receives a fixed potential VF. N-channel MOS transistor 25 constitutes a constant current source. MOS transistors 11 to 25 constitute a differential amplifier. P-channel MOS transistor 13 is connected between the line at external power supply potential VCC0 and node N13 and the gate thereof is connected to node N11. Capacitor 33 is connected between node N13 and the line at ground potential GND.

Since N-channel MOS transistor 24 and P-channel MOS transistor 12 are connected in series with each other and P-channel MOS transistors 11 and 12 constitute a current mirror circuit, a current corresponding to monitor potential VM flows in P-channel MOS transistor 11. When monitor potential VM is higher than reference potential VR1, a current flowing in P-channel MOS transistor 11 is larger than a current flowing in N-channel MOS transistor 23 to thereby cause node N11 to have H level and to cause P-channel MOS transistor 13 to be non-conductive. When monitor potential VM is lower than reference potential VR1, a current flowing in P-channel MOS transistor 11 is smaller than a current flowing in N-channel MOS transistor 23 to thereby cause node N11 to have L level, to cause P-channel MOS transistor 13 to be conductive and to charge node N13. A potential at node N13 becomes output potential VCC1 of VCC1 generating circuit 2.

Control potential generating circuit 4 includes: a P-channel MOS transistor 16, an N-channel MOS transistor 28, a P-channel MOS transistor 17 and an N-channel MOS transistor 29, connected in series between output node N13 of VCC1 generating circuit 2 and the line of ground potential GND. The gates of MOS transistors 16 and 29 receive internal power supply potential VO. The gate of N-channel MOS transistor 28 is connected to the drain thereof and the gate of P-channel MOS transistor 17 is connected to the drain thereof. MOS transistors 27 and 18 constitute respective diode elements. Control potential VC appears at node N28 between MOS transistors 28 and 17. Transistor parameters of MOS transistors 16, 17, 28 and 29 are set in order that when internal power supply potential VO is 1/2 times potential VCC1 at node N13, VC=VCC1/2. Control potential generating circuit 4 controls MOS transistors 30 and 20 in order that VO=VC. As described in section of the description of the background art, however, it is assumed here that transistor parameters of MOS transistors 16, 17, 28 and 29 are not controlled so as to match with design values, with the result that VC=VO=VCC1/2+ΔV.

Drive circuit 5 includes: P-channel MOS transistors 18 to 20; and N-channel MOS transistors 30 to 32. P-channel MOS transistors 18 and 19 are connected between the line of external power supply potential VCC0 and node N18 and between the line of external power supply potential VCC0 and node N19. The gates of both are connected to node N18. P-channel MOS transistors 18 and 19 constitute a current mirror circuit. A potential appearing at node N19 becomes internal power supply potential VO. N-channel MOS transistor 30 is connected between nodes N18 and N19 and the gate thereof is connected to the gate of N-channel MOS transistor 28. P-channel MOS transistor 20 is connected between nodes N19 and N20 and the gate thereof is connected to the gate of P-channel MOS transistor 17. N-channel MOS transistors 31 and 32 are connected between node N20 and the line at ground potential GND and between node N19 and the line at ground potential GND and the gates of both are connected to node N20. N-channel MOS transistors 31 and 32 constitute a current mirror circuit.

A ratio W28/W30 between transistor sizes of N-channel MOS transistors 28 and 30 is equal to a ratio W17/W20 between transistor sizes of P-channel MOS transistors 17 and 20. Furthermore, a ratio W18/W19 between transistor sizes of P-channel MOS transistors 18 and 19 is equal to a ratio W31/W32 between transistor sizes of N-channel MOS transistors 31 and 32. P-channel MOS transistors 18 and 19 cause a current W19/W18 times a current flowing in N-channel MOS transistor 30 to flow into node N19. P-channel MOS transistors 31 and 32 cause a current W32/W31 times a current flowing in P-channel MOS transistor 20 to flow out from node N19.

Not only is a threshold voltage of N-channel MOS transistor 30 set to a value higher than that of N-channel MOS transistor 28 in order that no through current flows into the line at ground potential GND from the line at external power supply potential VCC0 through MOS transistors 18, 30, 20 and 31, but a threshold voltage of MOS transistor 20 is set to a value higher than that of P-channel MOS transistor 17. With such setting, when output potential VO resides in a dead band from lower limit value VL=VR0/2−ΔV1 to upper limit value VH=VR0/2+ΔV2, MOS transistors 30 and 20 are both become non-conductive.

When internal power supply potential VO becomes higher than upper limit value VH, not only does a resistance value of P-channel MOS transistor 16 higher, but a resistance value of N-channel MOS transistor 29 also becomes lower to lower gate potentials of MOS transistors 17, 20, 28 and 30, to cause P-channel MOS transistor 20 to be conductive and to lower internal power supply potential VO.

When internal power supply potential VO becomes lower than lower limit value VL, not only does a resistance value of P-channel MOS transistor 16 become lower, but a resistance value of N-channel MOS transistor 29 also becomes higher to raise gate potentials of MOS transistors 17, 20, 28 and 30, to cause N-channel MOS transistor 30 to be conductive and to raise internal power supply potential VO. Internal power supply potential VO is, therefore, held at a potential between lower limit value VL and upper limit value VH.

Monitor potential generating circuit 3 is a replica circuit of control potential generating circuit 4 and includes: P-channel MOS transistor 14, N-channel MOS transistor 26, P-channel MOS transistor 15 and N-channel MOS transistor 27, connected in series between node N13 and the line of ground potential GND. The gates of MOS transistors 14 and 27 are connected to node N26 between MOS transistors 26 and 15. A potential appeared at node N26 becomes monitor potential VM. The gate of N-channel MOS transistor 26 is connected to the drain thereof and the gate of P-channel MOS transistor 15 is connected to the drain thereof.

A ratio W14/W16 between transistor sizes of P-channel MOS transistors 14 and 16, a ratio W26/W28 between transistor sizes of N-channel MOS transistors 26 and 28, a ratio W15/W17 between transistor sizes of P-channel MOS transistors 15 and 17 and a ratio W27/W29 between transistor sizes of N-channel MOS transistors 27 and 29 are mutually equal to each other. Therefore, VM=VC=VO.

VCC1 generating circuit 2, as described above, controls VCC1 in order that VM=VC=VR0/2. Therefore, even if transistor parameters of MOS transistors 16, 17, 28 and 29, that is transistor parameters of MOS transistors 14, 15, 26 and 27 do not become respective corresponding design values with the result that VC=VO=VCC1/2+ΔV, VO=VR0/2. Therefore, internal power supply potential VO can be controlled with correctness.

Figure 2:
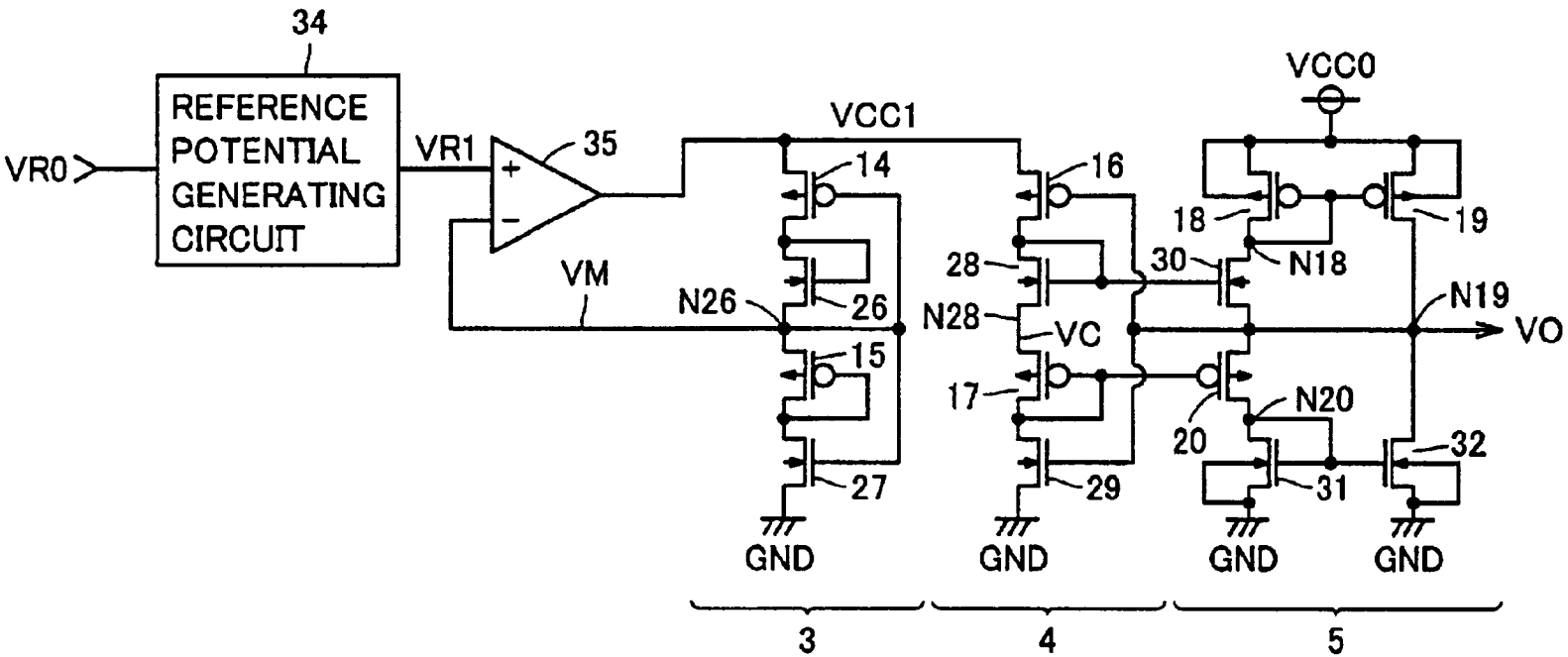
FIG. 2 is a circuit block diagram showing a modification example of the first embodiment.

A configuration may be adopted that as shown in FIG. 2, potential dividing circuit 1 and VCC1 generating circuit 2 are replaced with a reference potential generating circuit 34 and an operational amplifier 35, respectively. Reference potential generating circuit 34 generates reference potential VR1=VR0/K (where K is a positive real number) on the basis of reference voltage VR0. A non-inverting input terminal of operational amplifier 35 receives reference potential VR1, an inverting input terminal thereof receives monitor potential VM and an output terminal thereof is connected to the sources of P-channel MOS transistors 14 and 16. Operational amplifier 35 controls VCC1 in order that monitor potential VM coincides with reference potential VR1. In this modification example, VO=VR1.

Figure 3:
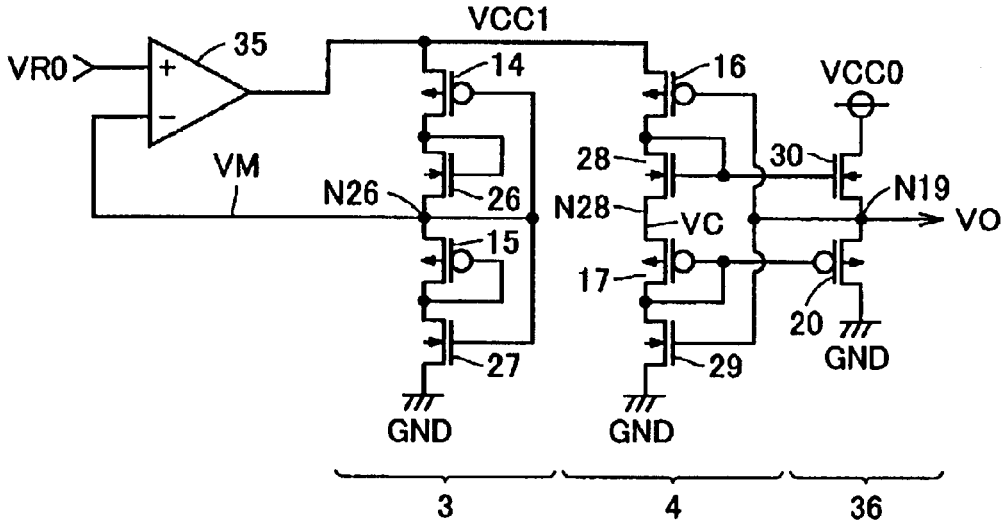
FIG. 3 is a circuit diagram showing another modification example of the first embodiment.

Furthermore, as shown in FIG. 3, a configuration may be adopted in which reference potential generating circuit 34 is removed and drive circuit 5 is replaced with a drive circuit 36. Drive circuit 36 is configured in a way that P-channel MOS transistors 18 and 19, and N-channel MOS transistors 31 and 32 of drive circuit 5 are removed and the sources of MOS transistors 30 and 20 are connected to the line of external power supply potential VCC0 and the line of ground potential GND, respectively. In this modification example of FIG. 3, VO=VR0. Since MOS transistors 18, 19, 31 and 32 are removed, a layout area is favorably smaller though a current drive ability of internal power supply potential is reduced.

Second Embodiment

Figure 4:
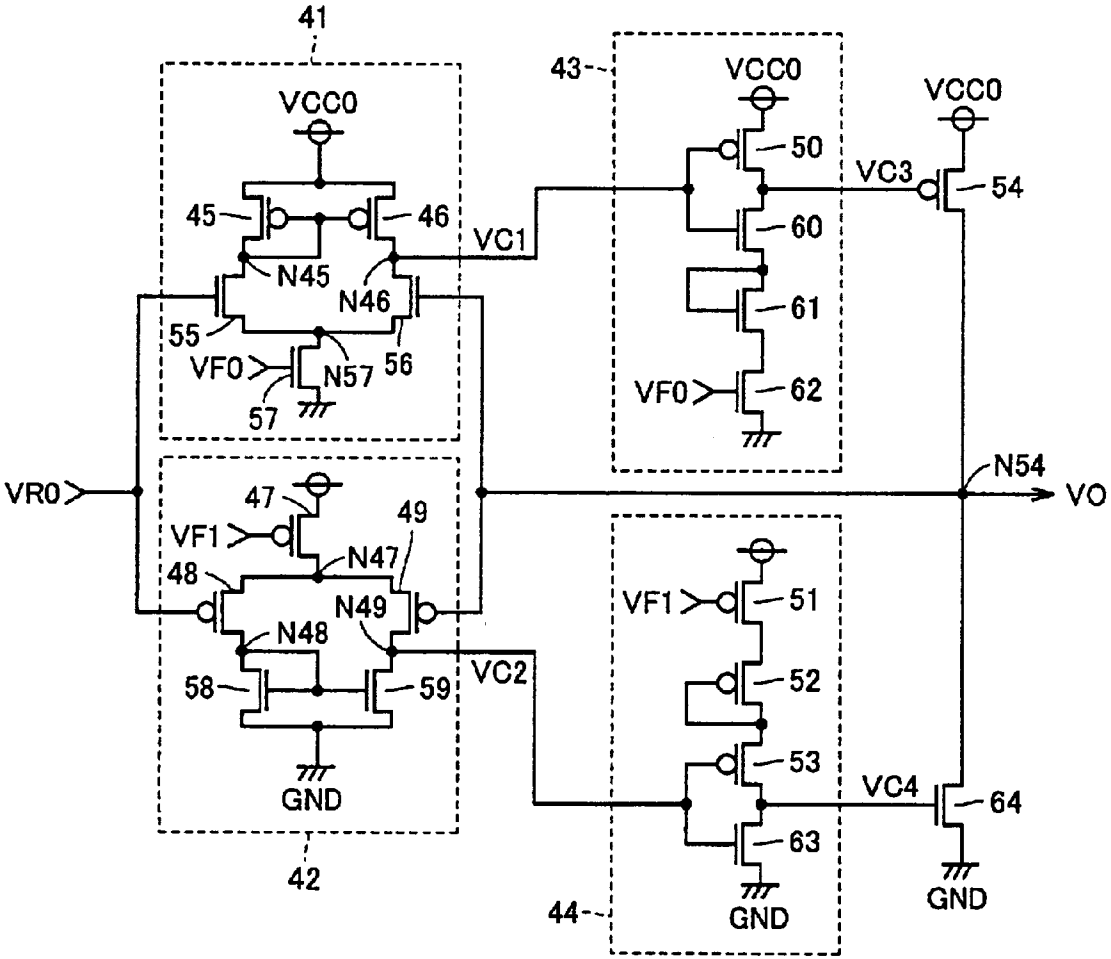
FIG. 4 is a circuit diagram showing a configuration of an internal power supply potential generating circuit according to a second embodiment of the present invention.

FIG. 4 is a circuit diagram showing a configuration of an internal power supply potential generating circuit according to the second embodiment of the present invention. In FIG. 4, the internal power supply potential generating circuit includes: a lower limit potential comparison circuit 41; an upper limit potential comparison circuit 42; inverters 43 and 44; a P-channel MOS transistor 54; and an N-channel MOS transistor 64.

Lower limit potential comparison circuit 41 includes: P-channel MOS transistors 45 and 46; and N-channel MOS transistors 55 to 57. P-channel MOS transistors 45 and 46 are connected between a line at external power supply potential VCC0 and a node N45, and between the line of external power supply potential VCC0 and a node N46, respectively, and the gates of both are connected to node N45. P-channel MOS transistors 45 and 46 constitute a current mirror circuit. N-channel MOS transistors 55 and 56 are connected between a node N45 and a node N57, and between a node N46 and node N57, respectively, and the gates of both receive reference potential VR0 and internal power supply potential VO, respectively. N-channel MOS transistor 57 is connected between node 57 and a line at ground potential GND and the gate thereof receives fixed potential VF0. N-channel MOS transistor 57 constitutes a constant current source. MOS transistors 45, 46 and 55 to 57 constitute a differential amplifier. A signal appearing at node N46 becomes output signal VC1 of lower limit potential comparison circuit 41.

A ratio W45/W46 between transistor sizes of P-channel MOS transistors 45 and 46 is larger than a ratio W55/W56 between transistor sizes of N-channel MOS transistors 55 and 56. For example, channel widths W45, W46 and W55 of MOS transistors 45, 46 and 55 are equal to each other and a channel width W56 of MOS transistor 56 is larger than W45=W46=W55. In case where VO=VR0, therefore, a current I46 flowing in P-channel MOS transistor 46 becomes smaller than a current I56 flowing in N-channel MOS transistor 56, while when internal power supply potential VO becomes lower limit value VL=VR0−ΔV1, I46=I56.

When internal power supply potential VO is higher than lower limit value VL, therefore, current I46 flowing in P-channel MOS transistor 46 becomes smaller than current I56 flowing in N-channel MOS transistor 56 to cause output signal VC1 to be at L level, while internal power supply potential VO is lower than lower limit value VL, I46 becomes larger than I56 to cause output signal VC1 to be at H level.

Upper limit potential comparison circuit 42 includes: P-channel MOS transistors 47 to 49; and N-channel MOS transistors 58 and 59. P-channel MOS transistor 47 is connected between the line of external power supply potential VCC0 and a node N47 and the gate thereof receives fixed potential VF1. P-channel MOS transistor 47 constitutes a constant current source. P-channel MOS transistors 48 and 49 are connected between node N47 and node N48, and between node N47 and node N49, respectively, and the gates of both receive reference potential VR0 and internal power supply potential VO, respectively. N-channel MOS transistors 58 and 59 are connected between node N48 and the line of ground potential GND, and between node N49 and the line of ground potential GND and the gates of both are connected to node N48. N-channel MOS transistors 58 and 59 constitute a current mirror circuit. MOS transistors 47 to 49, 58 and 59 constitute a differential amplifier. A signal appearing at node N49 becomes an output signal VC2 of upper limit potential comparison circuit 42.

A ratio W48/W49 between transistor sizes of P-channel MOS transistors 48 and 49 is smaller than a ratio W58/W59 between transistor sizes of N-channel MOS transistors 58 and 59. For example, channel widths W48, W58 and W59 of MOS transistors 48, 58 and 59 are equal to each other and a channel width W49 of MOS transistor 49 is larger than channel widths W48=W58=W59. Therefore, when VO=VR0, a current I49 flowing in P-channel MOS transistor 49 becomes larger than a current I59 flowing in N-channel MOS transistor 59, while when VO becomes upper limit value VH=VR0+ΔV2, I49=I59.

When internal power supply potential VO is higher than upper limit value VH, therefore, current I49 flowing in P-channel MOS transistor 49 becomes smaller than current I59 flowing in N-channel MOS transistor 59 to cause output signal VS2 to be at L level, while when VO is lower than upper limit value VH, I49 becomes larger than I59 to cause output signal VC2 to be at H level.

Inverter 43 includes: P-channel MOS transistor 50 and N-channel MOS transistors 60 to 62, connected in series between the line of external power supply potential VCC0 and the line of ground potential GND. The gates of MOS transistors 50 and 60 receive output signal VC1 of lower limit potential comparison circuit 41. The gate of N-channel MOS transistor 61 is connected to the drain thereof N-channel MOS transistor 61 constitutes a diode element. N-channel MOS transistor 61 is provided in order to set a threshold voltage of inverter 43 at an intermediate level of a potential variation width of signal VC1 and to prevent a through current from flowing into the line of ground potential GND from the line of external power supply potential VCC0 through MOS transistors 50 and 60 to 62. The gate of N-channel MOS transistor 62 receives fixed potential VF0. N-channel MOS transistor 62 constitutes a current limiting element to prevent MOS transistors 54 and 64 from becoming simultaneously conductive. A signal appearing at a node between MOS transistors 50 and 60 becomes an output signal VC3 of inverter 43.

When signal VC1 is at L level, not only does P-channel MOS transistor 50 become conductive, but N-channel MOS transistor 60 also becomes non-conductive to cause output signal VC3 to be at H level. When signal VC1 is at H level, not only does P-channel MOS transistor 50 become non-conductive, but N-channel MOS transistor 60 also becomes conductive to cause output signal VC3 to be at L level.

Inverter 44 includes: P-channel MOS transistors 51 to 53; and N-channel MOS transistor 63, connected in series between the line of external power supply potential VCC0 and the line of ground potential GND. The gate of P-channel MOS transistor 51 receives fixed potential VF1. P-channel MOS transistor 51 constitutes a current limiting element to prevent MOS transistors 54 and 64 from becoming simultaneously conductive. The gate of P-channel MOS transistor 52 is connected to the drain thereof. P-channel MOS transistor 52 constitutes a diode element. P-channel MOS transistor 52 is provided in order to set a threshold voltage of inverter 44 to an intermediate level of a potential variation width of signal VC2 and to prevent a through current from flowing into the line of ground potential GND from the line of external power supply potential VCC0 through MOS transistors 51 to 53 and 63. The gates of MOS transistors 53 and 63 receive output signal VC2 of upper limit potential comparison circuit 42. A signal appearing at a node between MOS transistors 53 and 63 becomes an output signal VC4 of inverter 44.

When signal VC2 is at L level, not only does P-channel MOS transistor 53 become conductive, but N-channel MOS transistor 63 also becomes non-conductive to cause output signal VC4 to be at H level. When signal VC2 is at H level, not only does P-channel MOS transistor 53 become non-conductive, but N-channel MOS transistor 63 also becomes conductive to cause output signal VC4 to be at L level.

P-channel MOS transistor 54 is connected between the line of external power supply potential VCC0 and an output node N54 and the gate thereof receives output signal VC3 of inverter 43. P-channel MOS transistor 54 constitutes a pull-up driver. N-channel MOS transistor 64 is connected between output node N54 and the line of ground potential GND and the gate thereof receives output signal VC4 of inverter 44. A potential of output node N54 becomes internal power supply potential VO.

Description will then be given of operation of the internal power supply potential generating circuit. When internal power supply potential VO is in a dead band between lower limit value VL=VR0−ΔV1 and upper limit value VH=VR0+ΔV2, output signal VC1 of lower limit potential comparison circuit 41 takes L level and output signal VC3 takes H level to thereby cause P-channel MOS transistor 54 to be non-conductive. Furthermore, output signal VC2 of upper limit potential comparison circuit 42 takes H level and output signal VC4 takes L level to thereby cause N-channel MOS transistor 64 to be non-conductive. Therefore, output signal N54 enters a high impedance state.

When internal power supply potential VO becomes lower than lower limit value VL, output signal VC1 of lower limit potential comparison circuit 41 takes H level and output signal VC3 of inverter 43 takes L level to thereby cause P-channel MOS transistor 54 to be conductive, and a current flows into node N54 from the line of external power supply potential VCC0 through P-channel MOS transistor 54 to raise internal power supply potential VO. At this time, an output signal of upper limit potential comparison circuit 42 is kept unchanged at H level as is to hold P-channel MOS transistor 64 in a non-conductive state.

When internal power supply potential VO becomes higher than upper limit value VH, output signal VC2 of upper limit potential comparison circuit 42 takes H level and output signal VC4 of inverter 44 takes H level to thereby cause N-channel MOS transistor 64 to be conductive, and a current flows into the line of ground potential GND from node N54 to lower internal power supply potential VO. Furthermore, output signal VC1 of lower limit potential comparison circuit 41 takes L level and output signal VC3 of inverter 43 takes H level to thereby cause P-channel MOS transistor 54 to be non-conductive. At this time, since P-channel MOS transistor 51 is provided, a time in which signal VC3 alters a logical level thereof from L level to H level becomes shorter than a time in which signal VC4 alters a logical level thereof from L level to H level to thereby prevent MOS transistors 54 and 64 from becoming simultaneously conductive. Internal power supply potential VO is, therefore, held at a potential between lower limit value VL and upper limit value VH.

In the second embodiment, a dead band can be set with ease and correctness since ratios W45/W46 and W55/W56 between transistor sizes in lower limit potential comparison circuit 41 are adjusted to set lower limit value VL and ratios W48/W49 and W58/W59 between transistor sizes in upper limit potential comparison circuit 42 are adjusted to set upper limit value VH.

Figure 5:
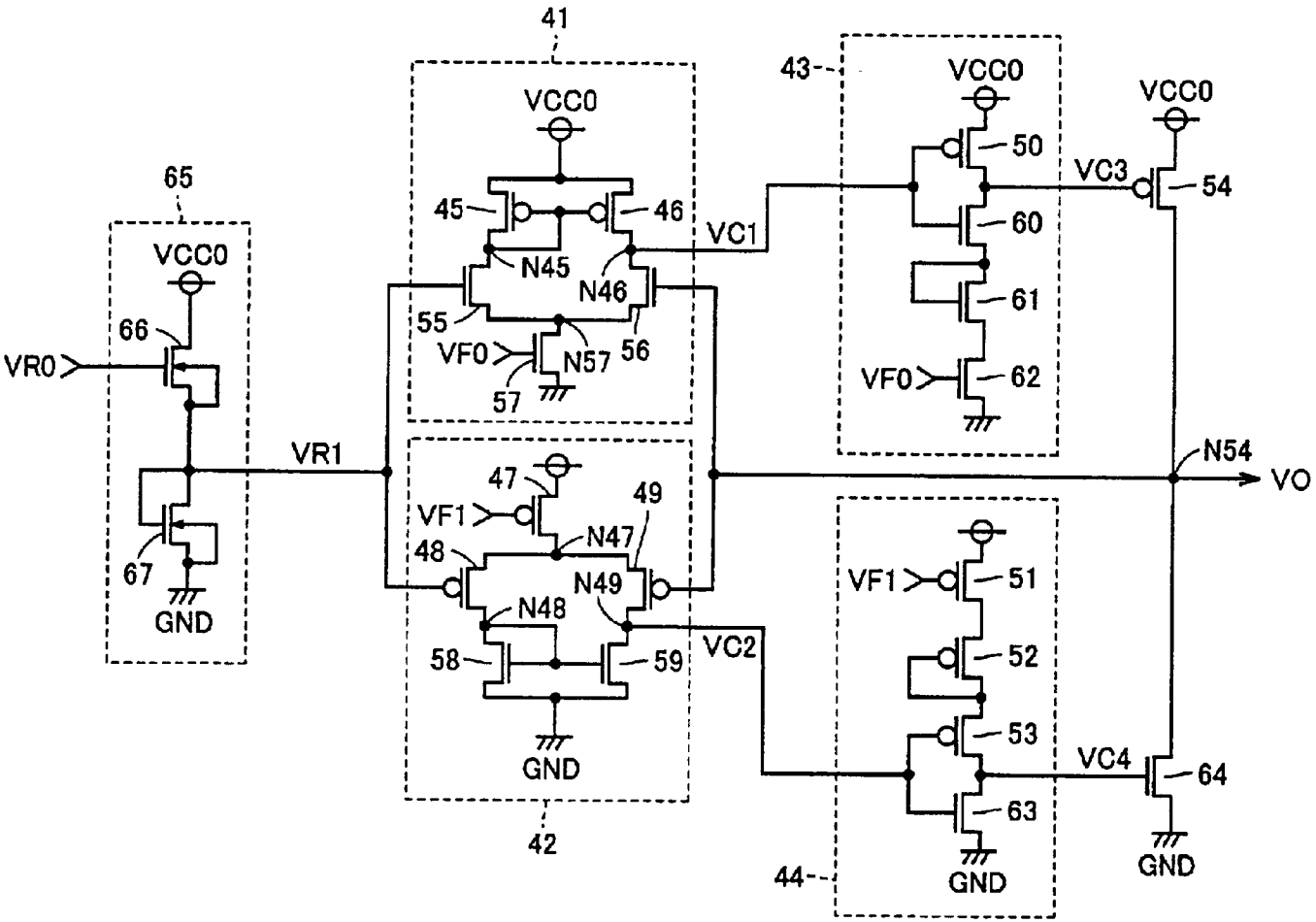
FIG. 5 is a circuit diagram showing a modification example of the second embodiment.

Description will below be made of various modification examples of the second embodiment. In a modification example of FIG. 5, a potential dividing circuit 65 is added. Potential dividing circuit 65 includes: N-channel MOS transistors 66 and 67 connected in series between the line of external power supply potential VCC0 and the line of ground potential GND. The gate of N-channel MOS transistor 66 receives reference potential VR0. The gate of N-channel MOS transistor 67 is connected to the drain thereof. Potential VR1=VR0/2 1/2 times reference potential VR0 appears at a node between N-channel MOS transistors 66 and 67. Reference potential VR1 is given to lower limit potential comparison circuit 41 and upper limit potential comparison circuit 42 instead of reference potential VR0. In this modification example, internal power supply potential VO is held at a potential between lower limit value VL=VR1−ΔV1 and upper limit value VH=VR1+ΔV2.

Figure 6:
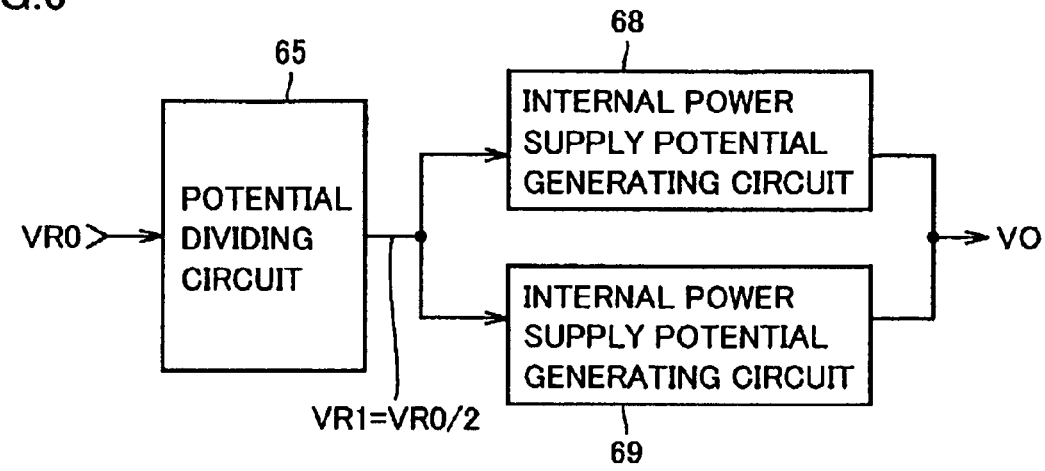
FIG. 6 is a block diagram showing another modification example of the second embodiment.

In a modification example of FIG. 6, there are provided potential dividing circuit 65 and two internal power supply potential generating circuits 68 and 69. Potential dividing circuit 65, as described in FIG. 5, generates reference potential VR1=VR0/2 on the basis of reference potential VR0. Internal power supply potential generating circuit 68 is of the same configuration as the internal power supply potential generating circuit shown in FIG. 3 and generates internal power supply potential VO on the basis of reference potential VR1. Internal power supply potential generating circuit 69 is of the same configuration as the internal power supply potential generating circuit shown in FIG. 4 and generates internal power supply potential VO on the basis of reference potential VR1. Internal power supply potential generating circuits 68 and 69 are connected in parallel to each other.

Figure 7A:
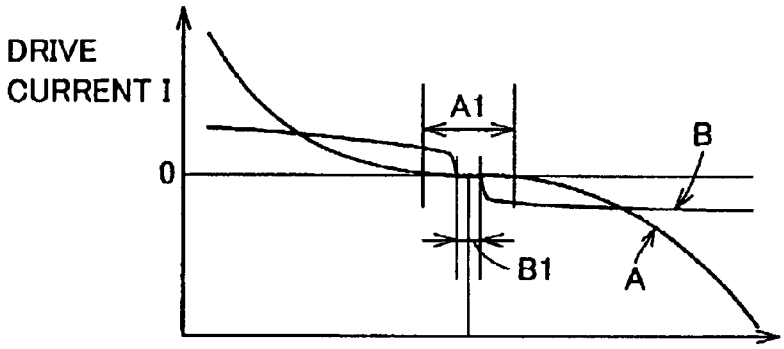
FIGS. 7A and 7B are graphs showing operations of the internal power supply potential generating circuit shown in FIG. 6.
Figure 7B:
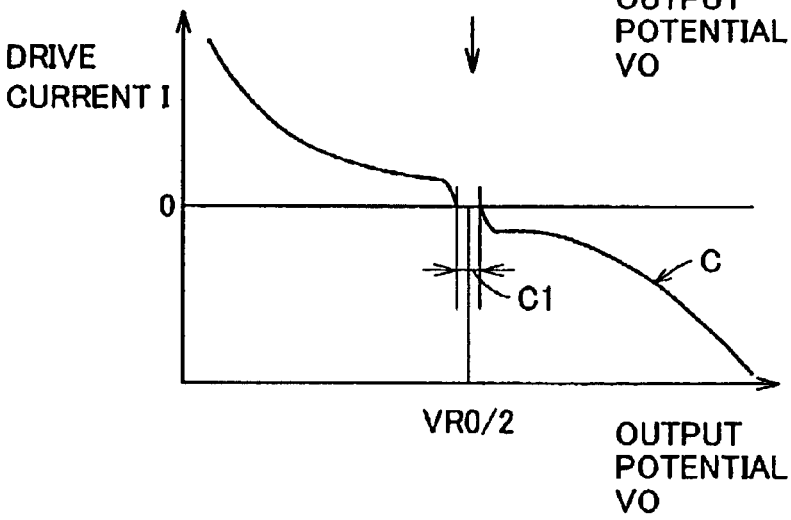

Internal power supply potential generating circuit 68, as shown by a curve A of FIG. 7A, has a comparatively large width of a dead band A1, while having a large current drive ability even when output potential VO shifts largely from reference potential VR1. Internal power supply potential generating circuit 69, as shown by a curve B of FIG. 7A, has a narrow width of a dead band B1 set with correctness, while having a small current drive ability when output potential VO shifts from reference potential VR1. Internal power supply potential generating circuit shown in FIG. 6 has a characteristic of a combination of characteristics of internal power supply potential generating circuits 68 and 69 and as shown by a curve C of FIG. 7B, has a narrow width of a dead band C1 set with correctness, while having a large current drive ability when output potential VO shifts largely from reference potential VR1. Note that a necessity exists for coincidence of the centers of dead bands A1 and B1 of internal power supply potential generating circuits 68 and 69 with each other in order to connect internal power supply potential generating circuits 68 and 69 in parallel to each other. This is enabled by the effect unique to the present invention that internal power supply potential VO can be controlled with correctness.

Figure 8:
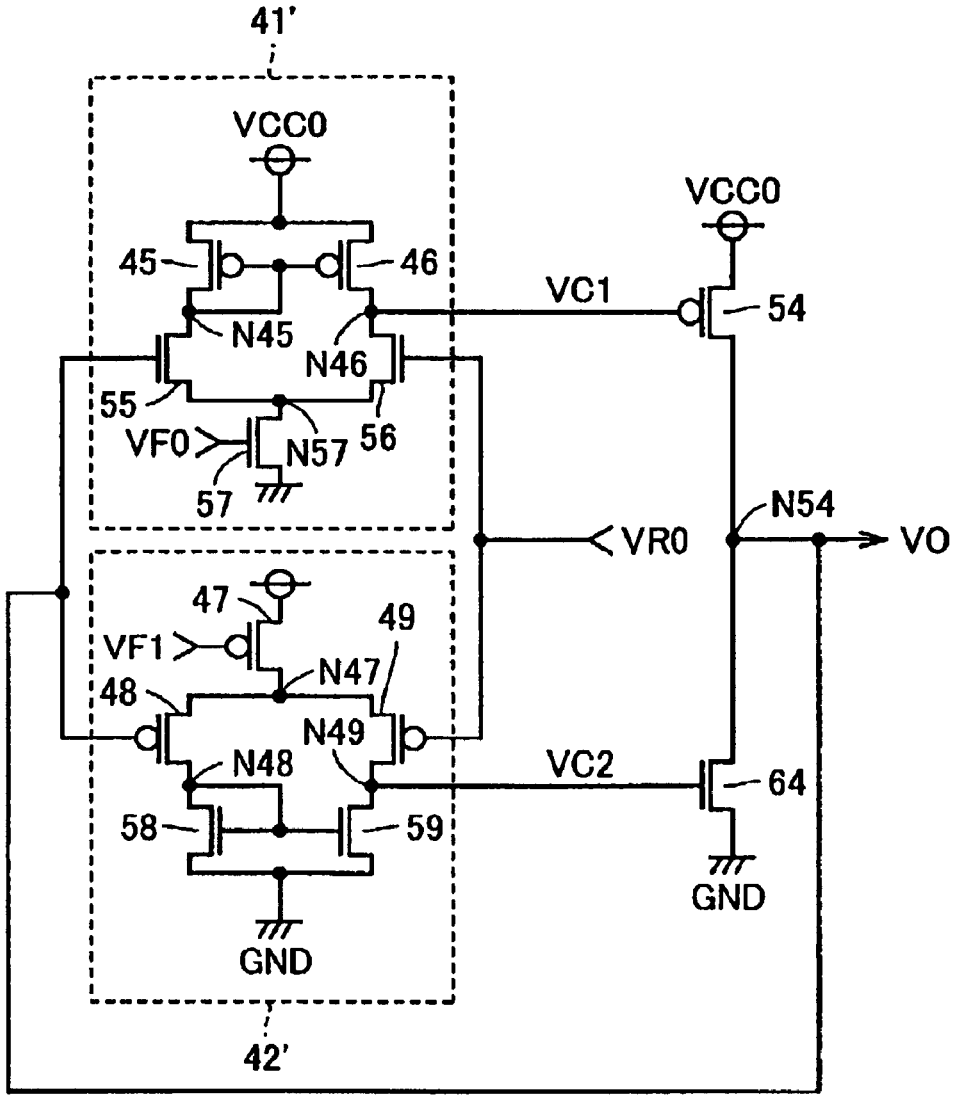
FIG. 8 is a circuit diagram showing still another modification example of the second embodiment.

A modification example of FIG. 8 is of a configuration obtained in a way that lower limit potential comparison circuit 41 and upper limit potential comparison circuit 42 of the internal power supply potential generating circuit of FIG. 4 are replaced with lower limit potential comparison circuit 41' and upper limit potential comparison circuit 42', respectively, and inverters 43 and 44 are removed therefrom. In lower limit potential comparison circuit 41', the gates of MOS transistors 55 and 56 receive output potential VO and reference potential VR0, respectively, and signal VC1 is given directly to the gate of P-channel MOS transistor 54. A ratio W45/W46 between transistor sizes of P-channel MOS transistors 45 and 46 is set to a value smaller than a ratio W55/W56 between transistor sizes of N-channel MOS transistors 55 and 56. For example, channel widths W45, W46 and W55 of MOS transistors 45, 46 and 55 are equal to each other and a channel width W56 of MOS transistor 56 is smaller than W45=W46=W55.

Therefore, when VO=VR0, current I46 flowing in N-channel MOS transistor 46 becomes larger than current I56 flowing in N-channel MOS transistor 56, while when lower limit value VL=VR0−ΔV1, I46=I56. Accordingly, when VO is higher than lower limit value VL, I46>I56 and signal VC1 takes H level to cause P-channel MOS transistor 54 to be non-conductive. When VO is lower than lower limit value VL, I46<I56 and signal takes L level to cause P-channel MOS transistor 54 to be conductive.

In upper limit potential comparison circuit 42', the gates of MOS transistors 48 and 49 receive output potential VO and reference potential VR0, respectively, and signal VC2 is given directly to the gate of N-channel MOS transistor 64. A ratio W48/W49 between transistor sizes of P-channel MOS transistors 48 and 49 is set to a value larger than a ratio W58/W59 between transistor sizes of N-channel MOS transistors 58 and 59. For example, channel widths of W48, W58 and W59 of MOS transistors 48, 58 and 59 are equal to each other and a channel width W49 of MOS transistor 49 is smaller than channel widths W48=W58=W59. Hence, when VO=VR0, current I49 flowing in P-channel MOS transistor 49 becomes smaller than current I59 flowing in N-channel MOS transistor 59, while when VO becomes VH=VR0+ΔV2, I49=I59.

Therefore, when VO is higher than upper limit value VH, I49>I59 and signal VC2 takes H level to cause N-channel MOS transistor 64 to be conductive. When VO is lower than upper value VH, I49<I59 and signal VC2 takes L level to cause N-channel MOS transistor 64 to be non-conductive. In this modification example, since signals VC1 and VC2 are inputted directly to the gates of MOS transistors 54 and 64 without passage through inverters 43 and 44, MOS transistors 54 and 64 are controlled in an analog manner. Furthermore, since inverters 43 and 44 are removed, a layout area is smaller.

Figure 9:
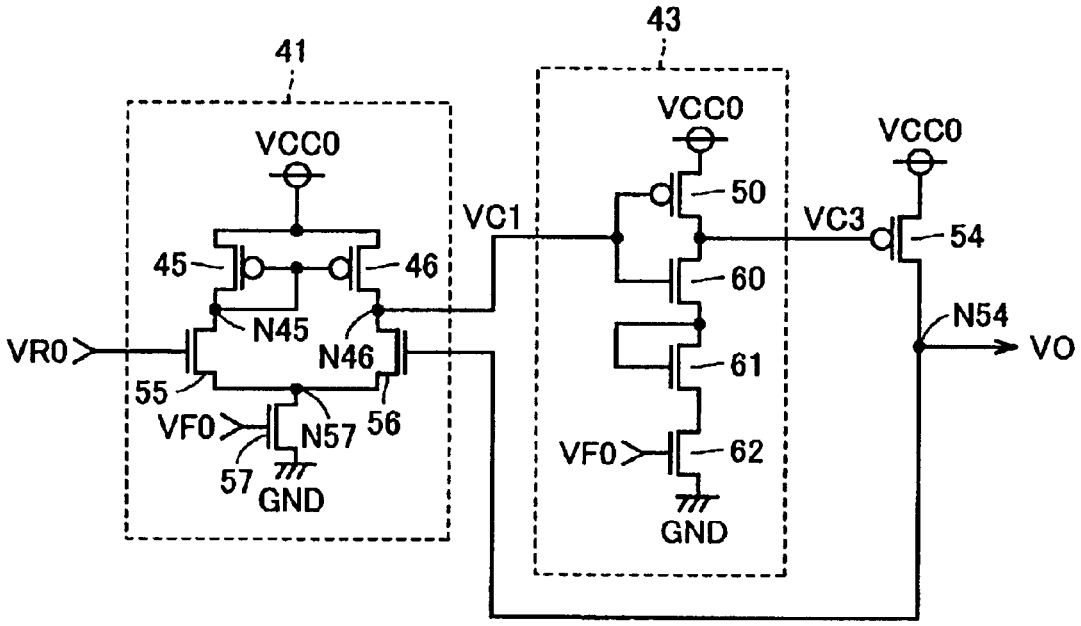
FIG. 9 is a circuit diagram showing still another modification example of the second embodiment.

A modification example of FIG. 9 is of a configuration obtained in a way that upper limit potential comparison circuit 42, inverter 44 and N-channel MOS transistor 64 are removed from the internal power supply potential generating circuit of FIG. 4. This can be used in a case where a current flows out into the line of ground potential GND from output node N54 through a load circuit (not shown) at all times. In this case, a layout area becomes smaller by a value corresponding to upper potential comparison circuit 42, inverter 44 and N-channel MOS transistor 64. Note that transistor sizes of N-channel MOS transistors 55 and 56 may the same as each other.

Figure 10:
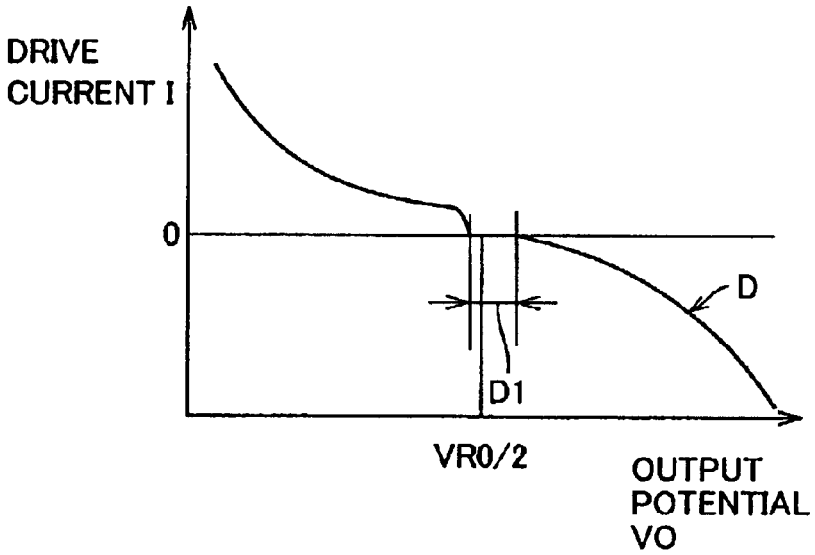
FIG. 10 is a graph showing an operation of still another modification example of the second embodiment.

In the modification example of FIG. 6, by replacing internal power supply potential generating circuit 69 with the internal power supply potential generating circuit shown in FIG. 9, there can be configured an internal power supply potential generating circuit with a current drive ability as shown in FIG. 10. In this case, there can be obtained an internal power supply potential generating circuit a charge capability of which is larger than a discharge capability of output node N54.

Figure 11:
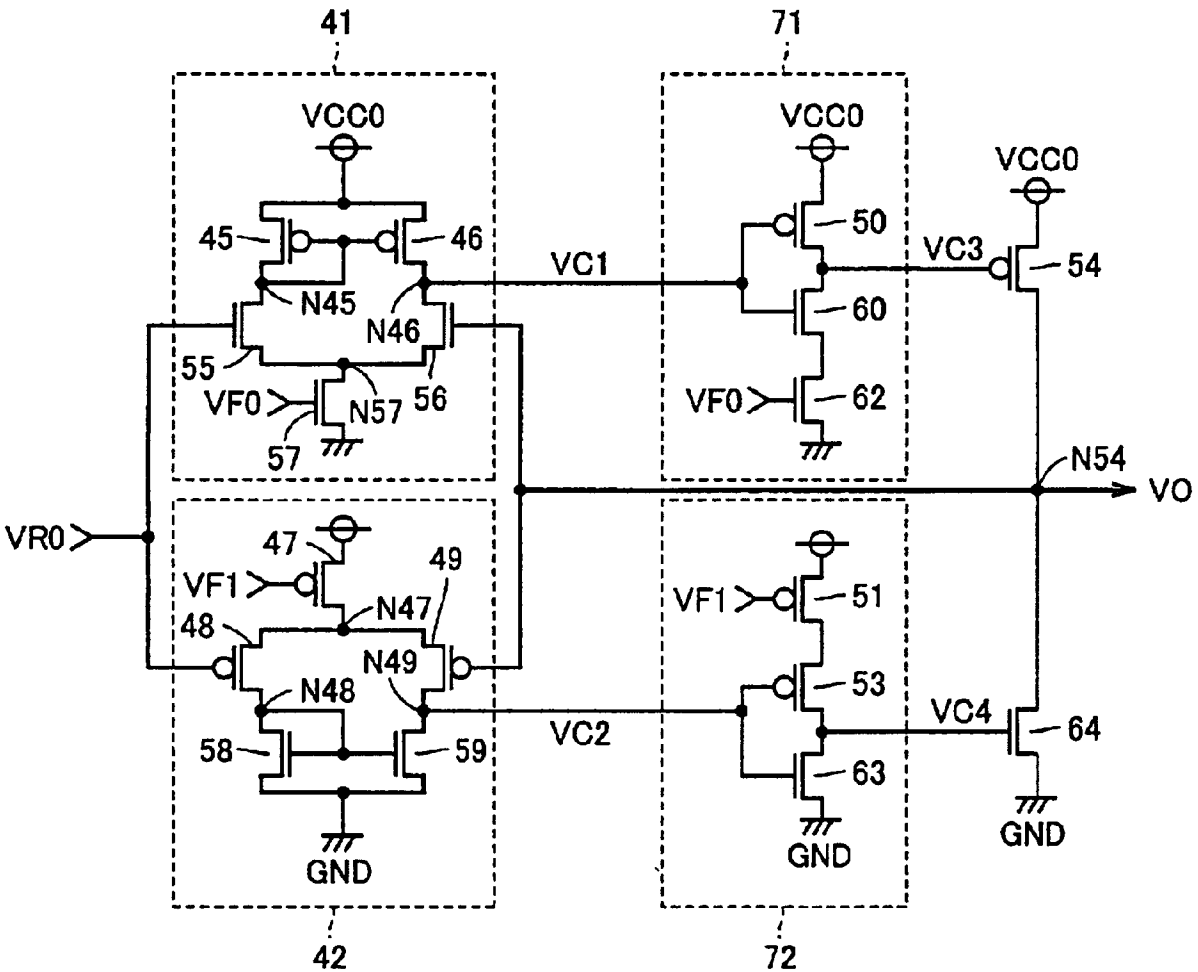
FIG. 11 is a circuit diagram showing still another modification example of the second embodiment.

A modification example of FIG. 11 is of a configuration obtained in a way that inverters 43 and 44 in the internal power supply potential circuit of FIG. 4 are replaced with inverters 71 and 72. Inverter 71 is constructed in a way that in inverter 43, N-channel MOS transistor 61 is removed and the source of N-channel MOS transistor 60 is connected to the drain of N-channel MOS transistor 62. Inverter 72 is constructed in a way that in inverter 44, N-channel MOS transistor 52 is removed and the drain of P-channel MOS transistor 51 is connected to the source of P-channel MOS transistor 53. In this modification example, since MOS transistors 61 and 52 are removed, output signals VC3 and VC4 of inverters 71 and 72 oscillate between external power supply potential VCC0 and ground potential GND. Accordingly, current drive abilities of P-channel MOS transistor 54 and N-channel MOS transistor 64 are enhanced.

Figure 12:
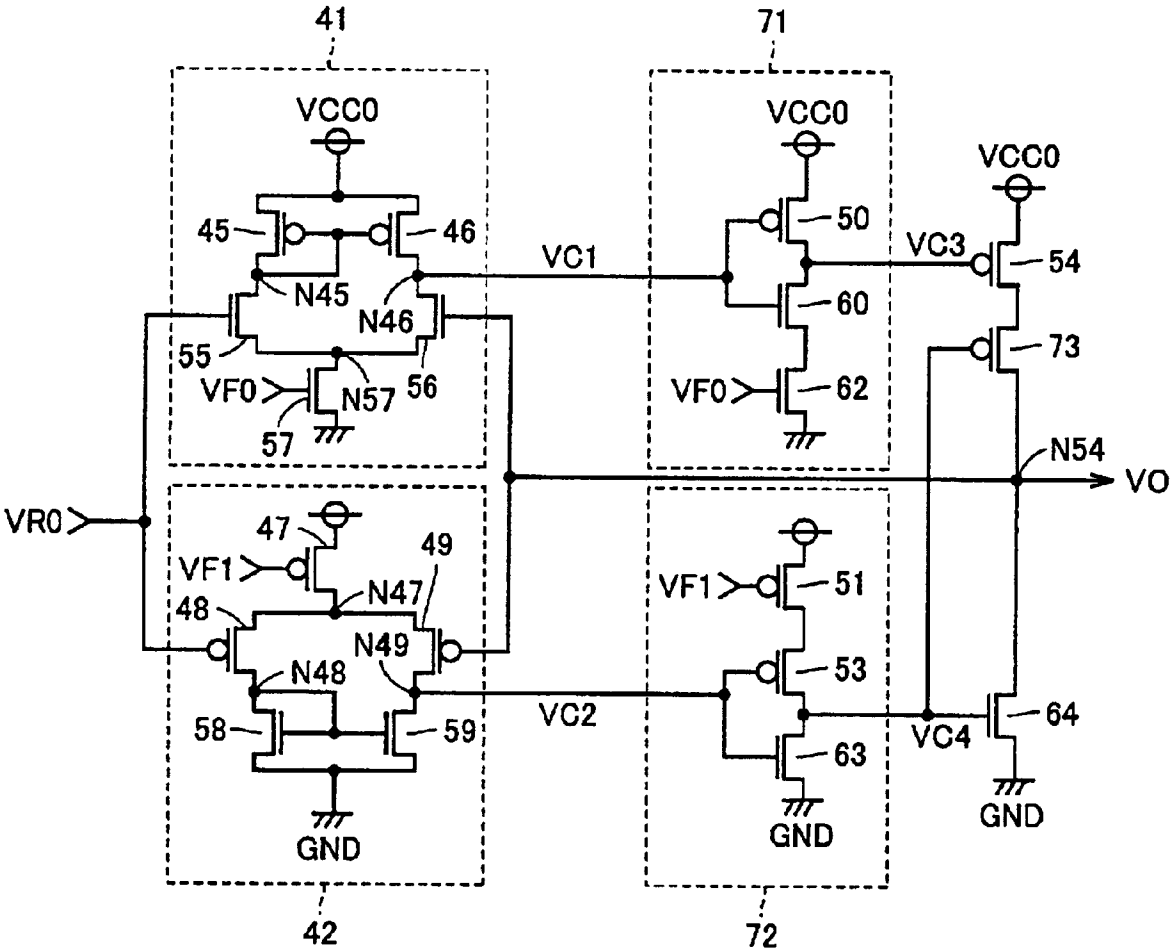
FIG. 12 is a circuit diagram showing still another modification example of the second embodiment.

A modification example of FIG. 12 is of a configuration obtained in a way that a P-channel MOS transistor 73 is added to the internal power supply potential generating circuit of FIG. 11. P-channel MOS transistor 73 is connected between the drain of P-channel MOS transistor 54 and output node N54 and the gate thereof receives output signal VC4 of inverter 72. When signal VC4 is at L level, not only does P-channel MOS transistor 73 becomes conductive, but N-channel MOS transistor 64 also becomes non-conductive, while when signal VC4 is at H level, not only does N-channel MOS transistor 73 become non-conductive, but N-channel MOS transistor 64 also becomes conductive. In this modification example, a through current can be prevented from flowing into the line of ground potential GND from the line of external power supply potential VCC0 through MOS transistors 54, 73 and 64.

Figure 13:
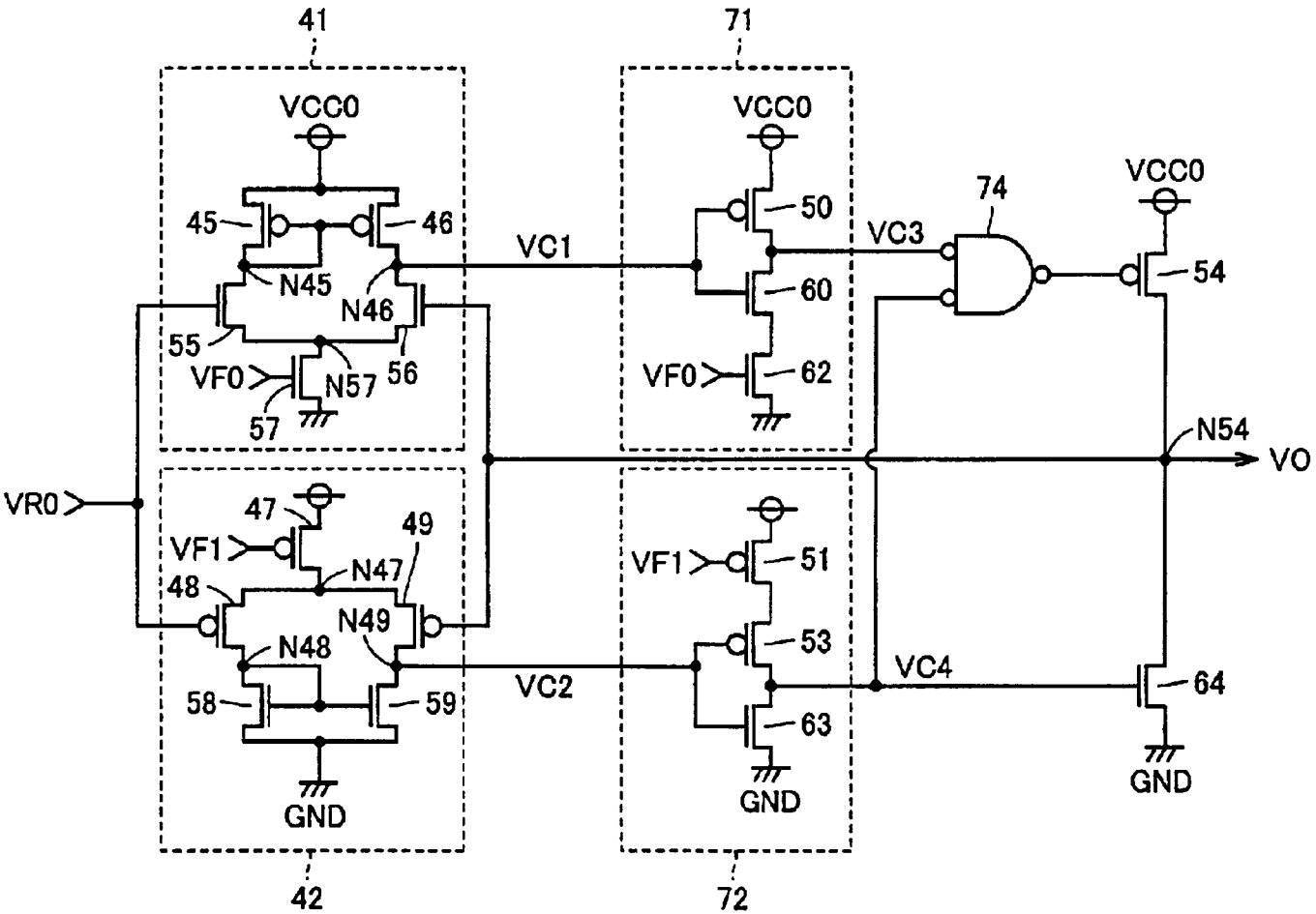
FIG. 13 is a circuit diagram showing still another modification example of the second embodiment.

A modification example of FIG. 13 is of a configuration obtained in a way that an OR gate 74 is added to the internal power supply potential circuit of FIG. 11. OR gate 74 receives output signals VC3 and VC4 of inverters 71 and 72 and output signal thereof is given to the gate of P-channel MOS transistor 54. When at least one of signals VC3 and VC4 takes H level, P-channel MOS transistor 54 becomes non-conductive. In this modification example as well, a through current can be prevented from flowing into the line of ground potential GND from the line of external power supply potential VCC0 through MOS transistors 54, 73 and 64.

Figure 14:
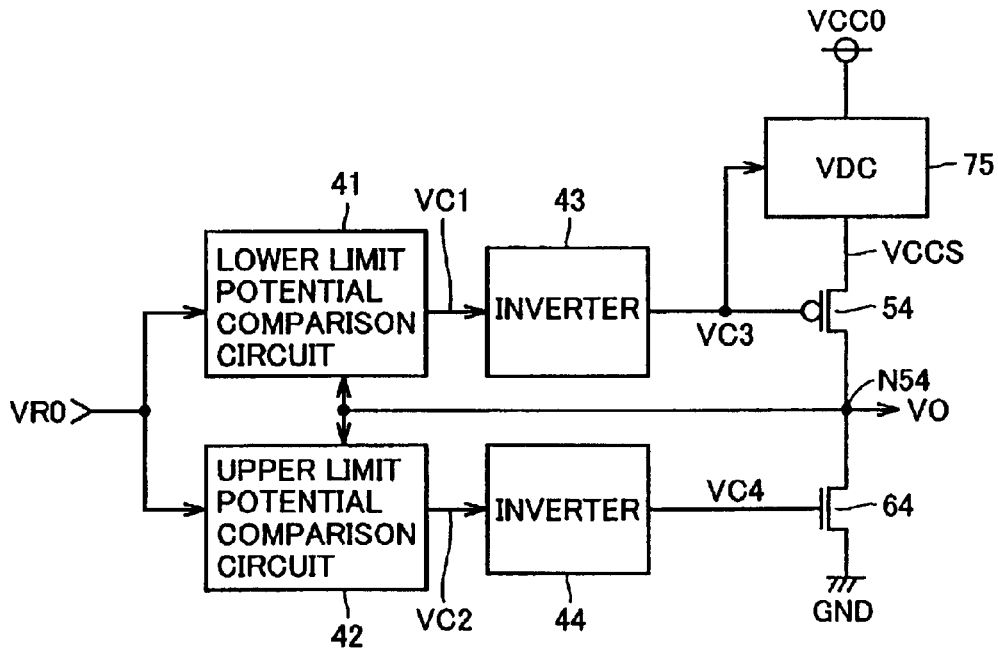
FIG. 14 is a circuit diagram showing still another modification example of the second embodiment.
Figure 15:
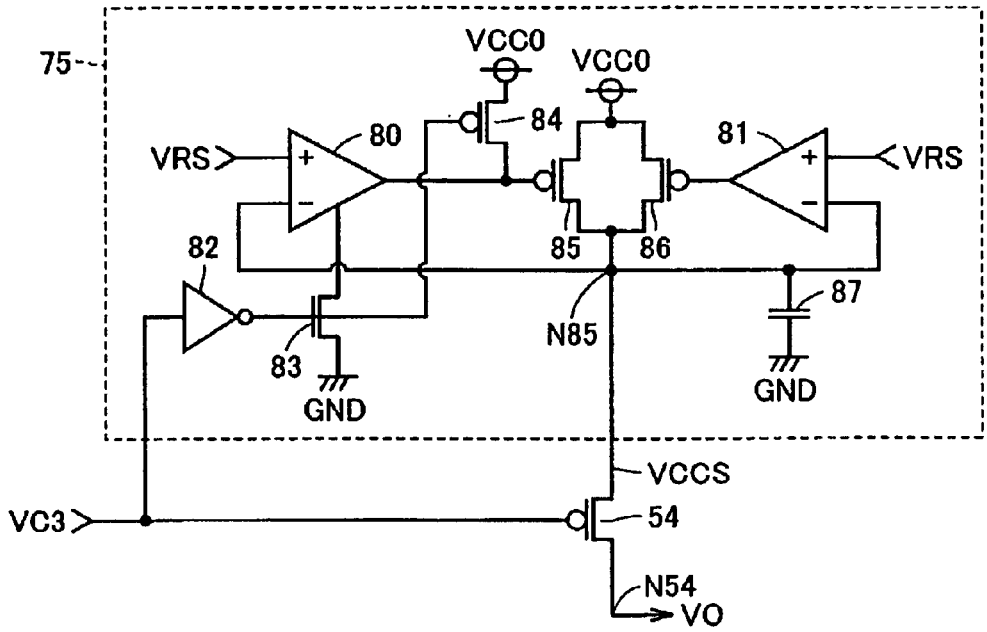
FIG. 15 is a circuit diagram showing a configuration of a set-down circuit shown in FIG. 14.

A modification example of FIG. 14 is of a configuration obtained in a way that a step-down circuit (VDC) 75 is added to the internal power supply potential generating circuit of FIG. 4. Step-down circuit 75 lowers external power supply potential VCC0 to generate internal power supply potential VCCS and to give internal power supply potential VCCS to the source of P-channel MOS transistor 54. A current drive ability of step-down circuit 75 becomes smaller when output signal VC3 of inverter 43 is at H level, while becoming larger when signal VC3 is at L level. That is, step-down circuit 75, as shown in FIG. 15, includes: operational amplifiers 80 and 81; an inverter 82; an N-channel MOS transistor 83; P-channel MOS transistors 84 to 86; and a capacitor 87.

P-channel MOS transistors 85 and 86 are connected in parallel between the line of external power supply potential VCC0 and the source (a node N85) of P-channel MOS transistor 54. A transistor size of P-channel MOS transistor 85 is larger than that of P-channel MOS transistor 86. The non-converting input terminal of operational amplifier 81 receives reference potential VRS, the inverting input terminal thereof is connected to node N85 and the output terminal thereof is connected to the gate of P-channel MOS transistor 86. Operational amplifier 81 controls a gate potential of P-channel MOS transistor 86 in order that a potential at node N85 coincides with reference potential VRS.

Operational amplifier 80 receives reference potential VRS at the non-inverting input terminal thereof, the inverting input terminal thereof is connected to node N85 and an output signal thereof is inputted to the gate of P-channel MOS transistor 85. N-channel MOS transistor 83 is connected between the ground node of operational amplifier 83 and the line of ground potential GND and P-channel MOS transistor 84 is connected between the line of external power supply potential VCC0 and the gate of P-channel MOS transistor 85. Output signal VC3 of inverter 43 is inputted to the gates of MOS transistors 83 and 84 through inverter 82. Capacitor 87 is connected between node N85 and the line of ground potential GND to stabilize potential VCCS at node N85.

When signal VC3 is at H level, N-channel MOS transistor 83 becomes non-conductive, not only is operational amplifier 80 deactivated, but P-channel MOS transistor 84 also becomes conductive, the gate of P-channel MOS transistor 85 is fixed at H level and P-channel MOS transistor 85 becomes non-conductive to decrease a current drive ability of step-down circuit 75. When signal VC3 is at L level, N-channel MOS transistor 83 becomes conductive, not only is operational amplifier 80 activated but P-channel MOS transistor 84 also becomes non-conductive, and operational amplifier 80 controls a gate potential of P-channel MOS transistor 84 in order that a potential at node N85 coincides with reference potential VRS to increase a current drive ability of step-down circuit 75. In this modification example, since a current drive ability of step-down circuit 75 increases only when P-channel MOS transistor 54 is caused to be conductive, while when P-channel MOS transistor 54 is caused to be non-conductive, a current drive ability of step-down circuit 75 decreases, a smaller power consumption of step-down circuit 75 is realized.

Third Embodiment

Figure 16:
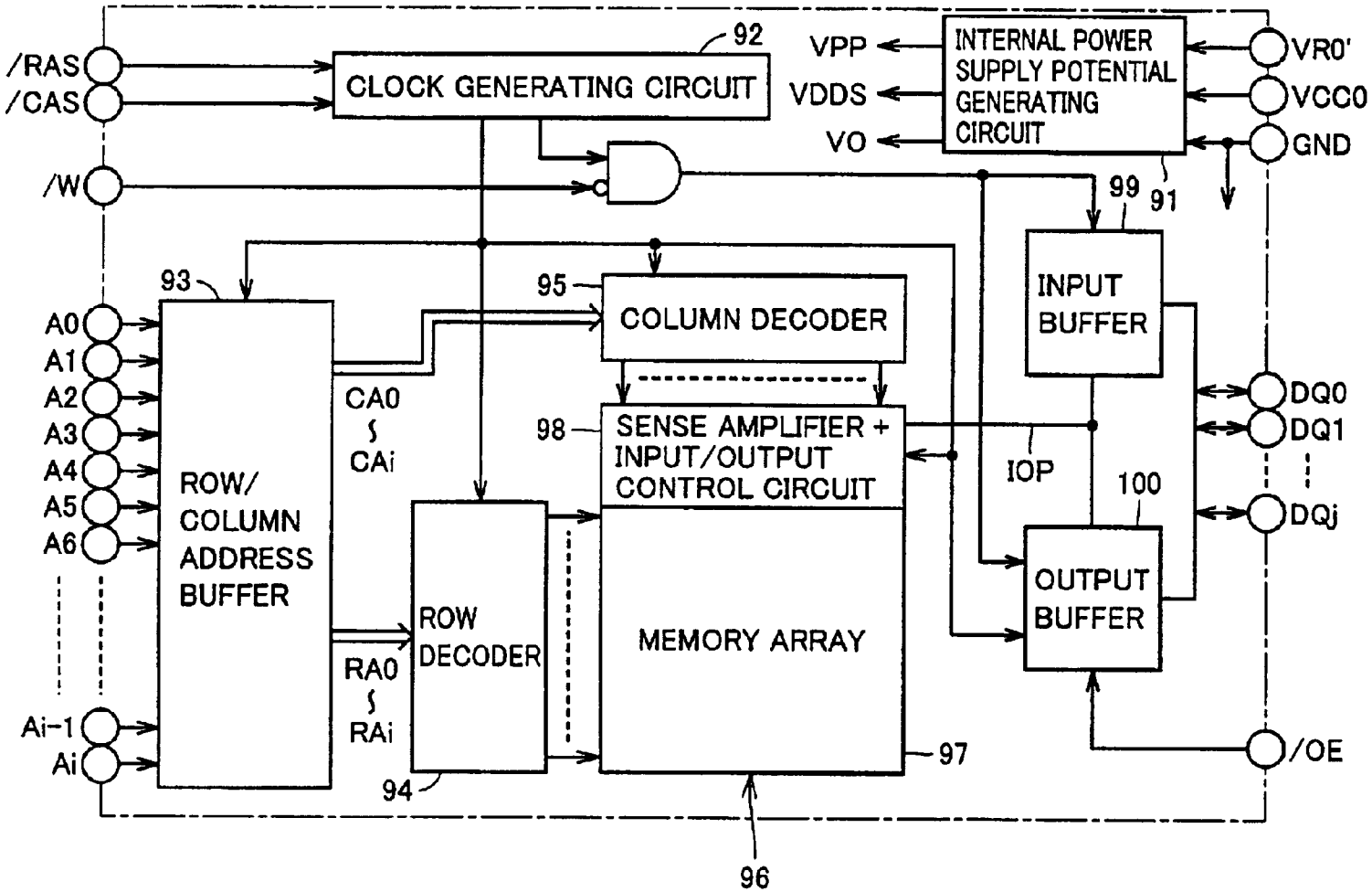
FIG. 16 is a circuit block diagram showing an overall configuration of a DRAM according to a third embodiment of the present invention.

FIG. 16 is a circuit block diagram showing an overall configuration of a DRAM according to a third embodiment of the present invention. In FIG. 16, the DRAM includes: an internal power supply potential generating circuit 91, a clock generating circuit 92; a row/column address buffer 93; a row decoder 94; a column decoder 95; a memory mat 96; an input buffer 99 and an output buffer 100, wherein memory mat 96 includes: a memory array 97 and a sense amplifier+input/output control circuit 98.

Internal power supply potential generating circuit 91 generates internal power supply potentials VPP, VDDS and VO on the basis of power supply potential VCC0, ground potential GND and reference potential VR0, given externally to supply over the entire DRAM. That is, internal power supply potential generating circuit 91, as described in FIG. 17, includes: a VPP generating circuit 101, a VDDS generating circuit 102 and a VR0/2 generating circuit 103. VPP generating circuit 10 generates internal power supply potential VPP used as a select level for a word line WL on the basis of external power supply potential VCC0 and internal power supply potential VDDS. Internal power supply potential VPP is maintained at VDDS+2Vthn. VDDS generating circuit 102 generates internal power supply potential VDDS for a sense amplifier 112 on the basis of external power supply potential VCC0 and reference potential VR0. Internal power supply potential VDDS is maintained at VR0.

VR0/2 generating circuit 103 is of the same configuration as the internal power supply potential generating circuit shown in FIG. 6 and generates internal power supply potential VO used as a bit line precharge potential VBL and a cell plate potential VCP on the basis of external power supply potential VCC0 and reference potential VR0. Internal power supply potential VO is maintained at VR0/2.

Clock generating circuit 92 selects a prescribed operating mode according to external control signals /RAS and /CAS to control the entire DRAM. Row/column address buffer 93 generates row address signals RA to RAi and column address signals CA0 to CAi according to external address signals A0 to Ai (where i is an integer of 0 or more) to give thus generated signals RA to RAi and CA0 to CAi to row decoder 94 and column decoder 95, respectively.

Memory array 97 includes: plural memory cells each storing 1 bit data. The memory cells are each placed at a site with a prescribed address to be composed of a row address and a column address.

Row decoder 94 designates a row address of memory array 97 according to row address signal RA0 to RAi given from row/column address buffer 93. Column decoder 95 designates a column address of memory array 97 according to column address signal CA0 to CAi given from tow/column address buffer 93.

Sense amplifier+input/output control circuit 98 connects a memory cell at an address designated by row decoder 94 and column decoder 95 to one end of a data input/output line pair IOP. The other end of data input/output line pair IOP is connected to input buffer 99 and output buffer 100. Input buffer 99, in write mode, responds to an external control signal /W to give a data signal Dj (where j is an integer of 0 or more) inputted externally to a selected memory cell through data input/output line pair IOP. Output buffer 100, in read mode, responds to an external control signal /OE to output a read data signal Qj from a selected memory cell to outside.

Figure 17:
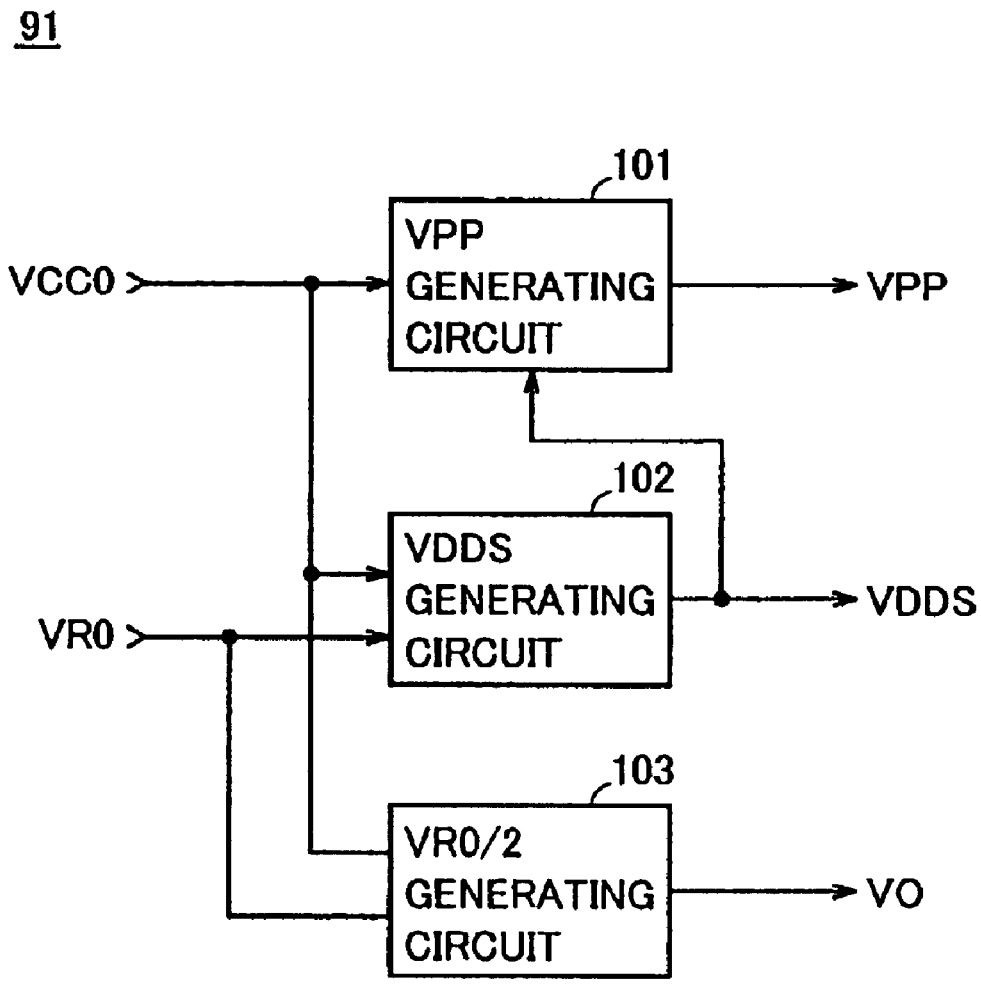
FIG. 17 is a block diagram showing a configuration of an internal power supply potential generating circuit shown in FIG. 16.
Figure 18:
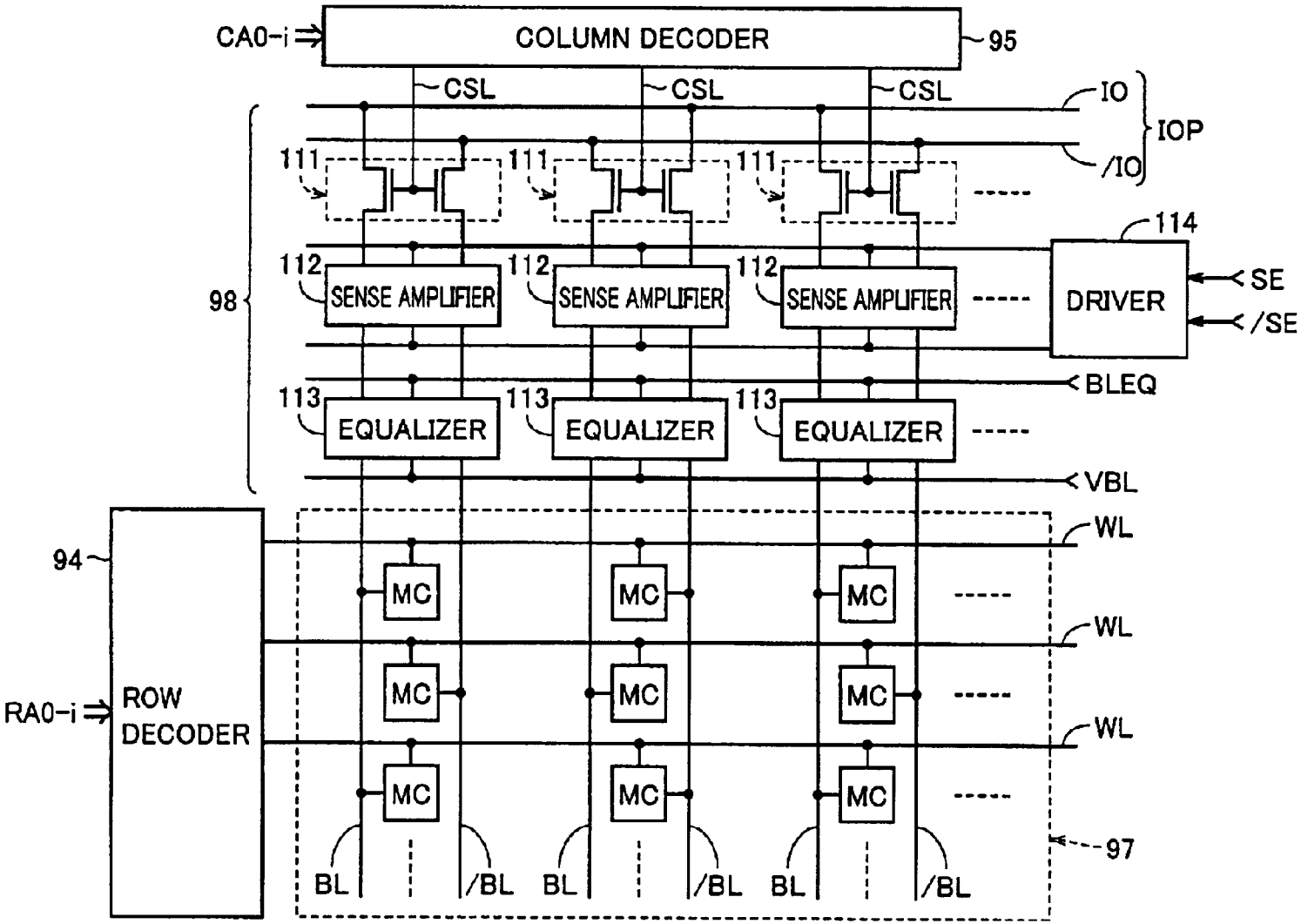
FIG. 18 is a circuit block diagram showing a configuration of a memory mat shown in FIG. 16.
Figure 19:
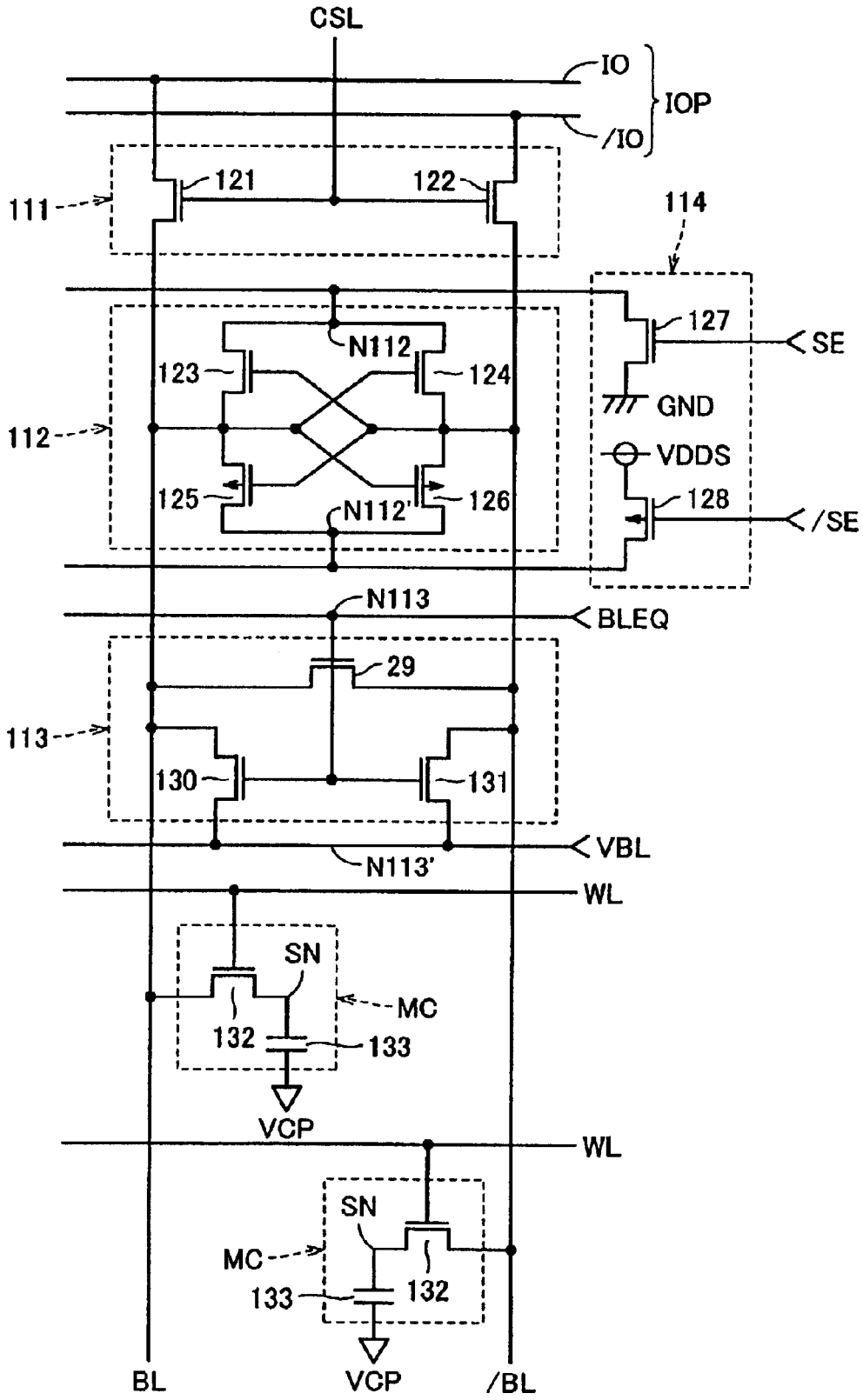
FIG. 19 is a circuit diagram showing a more detailed configuration of the memory mat shown in FIG. 18.

FIG. 18 is a circuit block diagram showing configurations of DRAM memory array 97 and sense amplifier+input/output control circuit 98 combined shown in FIG. 17 and FIG. 19 is a circuit diagram showing a more detailed configuration of one column in memory array 97 and sense amplifier+input/output control circuit 98 shown in FIG. 18.

Referring to FIGS. 18 and 19, memory array 97 includes: plural memory cells MC arranged in a matrix; word lines WL provided correspondingly to respective rows; and bit line pair BL and /BL provided correspondingly to respective columns. Each memory cell MC includes: an N-channel MOS transistor 132 for access; and a capacitor 133 for information storage. The gate of N-channel MOS transistor 132 of each memory cell MC is connected to a word line WL on a corresponding row. N-channel MOS transistor 132 is connected between bit line BL or /BL on a corresponding column and one electrode (storage node SN) of capacitor 133 of memory cell MC. The other electrode of capacitor 133 of each memory cell MC receives cell plate potential VCP. One end of each word line WL is connected to row decoder 94.

Sense amplifier+input/output control circuit 98 includes: column select lines CSL, column select gates 111, sense amplifiers 112 and equalizers 113 provided correspondingly to respective columns; a driver 114 and a data input/output line pair IO and /IO (IOP). Column select gate 111 includes: N-channel MOS transistors 121 and 122 connected between bit lines BL and /BL, respectively, of a corresponding pair and between data input/output lines IO and /IO. The gates of N-channel MOS transistors 121 and 122 are connected to column decoder 95 through corresponding column select line CSL. When column select line CSL is raised to H level at a select level by column decoder 95, N-channel MOS transistors 121 and 122 becomes conductive to couple bit lines BL and /BL to data input/output line pair IO and /IO.

Sense amplifier 112 includes: N-channel MOS transistors 123 and 124 connected between bit lines BL and a node N112, and between bit line /BL and node N112, respectively; and P-channel MOS transistors 125 and 126 connected between bit line BL and a node 112', and between bit line /BL and node N112', respectively. The gates of MOS transistors 123 and 125 are both connected to bit line /BL and the gates of MOS transistors 124 and 126 are both connected to bit line BL. Driver 114 includes: an N-channel MOS transistor 127 connected between node 112 and the line of ground potential GND and a P-channel MOS transistor 128 connected between node N112' and the line of internal power supply potential VDDS. MOS transistors 127 and 128 receive sense amplifier activation signals SE and /SE at the respective gates thereof. When sense amplifier activation signals SE and /SE take H level and L level, respectively, MOS transistors 127 and 128 become conductive, nodes N112 and N'112 take ground potential GND and internal power supply potential VDDS, respectively, and sense amplifier 112 amplifies a small potential difference between bit lines BL and /BL to internal power supply potential VDDS.

Equalizer 113 includes: an N-channel MOS transistor 129 connected between bit lines BL and /BL; and an N-channel MOS transistors 130 and 131 connected between bit line BL and a node N113', and between bit line /BL and node N113', respectively. The gates of N-channel MOS transistors 129 to 131 are all connected to a node N113. Node N113 receives a bit line equalize signal BLEQ and node N113' receives a bit line precharge potential VBL(=VO=VR0/2). Equalizer 113 equalizes potentials on bit lines BL and /BL to bit line precharge potential VBL in response to a rise of bit line equalize signal BLEQ to H level at activation level.

Description will then be given of operation of DRAM shown in FIGS. 16 to 19. In write mode, column select line CSL of a column corresponding to column address signals CA0 to CAi is raised to H level at select level by column decoder 95 to thereby cause column gate 111 of the column to be conductive.

Input buffer 99 responds to signal /W to give write data signal Dj given externally to bit lines BL and /BL on a selected column through data input/output line pair IOP. Write data signal Dj is given as a potential difference between bit lines BL and /BL. Then, a word line WL on a row corresponding to a row address signal RA0 to RAi is raised to H level at select level (internal power supply potential VPP) to cause MOS transistor 132 of memory cell MC on the row to be conductive. An electric charge corresponding to potentials on bit lines BL or /BL is stored in capacitor 133 of selected memory cell MC.

In read mode, bit line equalize signal BLEQ is at first lowered to L level to cause N-channel MOS transistors 129 to 131 of equalizer 113 to be non-conductive and to thereby cease equalization on bit lines BL and /BL. Then, a word line WL on a row corresponding to row address signal RA0 to RAi is raised to H level at select level by row decoder 94. In response to this, a potential on BL and /BL alter by a small amount according to an electric charge in capacitor 133 of activated memory cell MC.

Then, sense amplifier activation signal SE and /SE take H level and L level, respectively, to activate sense amplifier 112. When a potential on bit line BL is higher than that on bit line /BL by a small amount, resistance values of MOS transistors 124 and 125 are smaller than those of MOS transistors 123 and 126 to not only raise a potential on bit line BL to H level (internal power supply potential VDSS) but also lower a potential on bit line /BL to L level (ground potential GND). Contrary to this, when a potential on bit line /BL is higher than that on bit line BL by a small amount, resistance values of MOS transistors 123 and 126 are smaller than those of MOS transistors 124 and 125 to not-only raise a potential on bit line /BL to H level (internal power supply potential VDSS) but also lower a potential on bit line BL to L level (ground potential GND).

Then, column select line CSL on a column corresponding to column address signal CA0 to CAi is raised to H level at select level by column decoder 95 to cause column select gate 111 of the column to be conductive. Data on bit lines BL and /Bl on a selected column is given to output buffer 10 through column select gate 111 and data input/output line pair IO and /IO. Output buffer 100 responds to signal /OE to output read data signal Qj to outside.

In the third embodiment, bit line precharge potential VBL and cell plate potential VCP can be controlled to VR0/2 with correctness.

Figure 20:
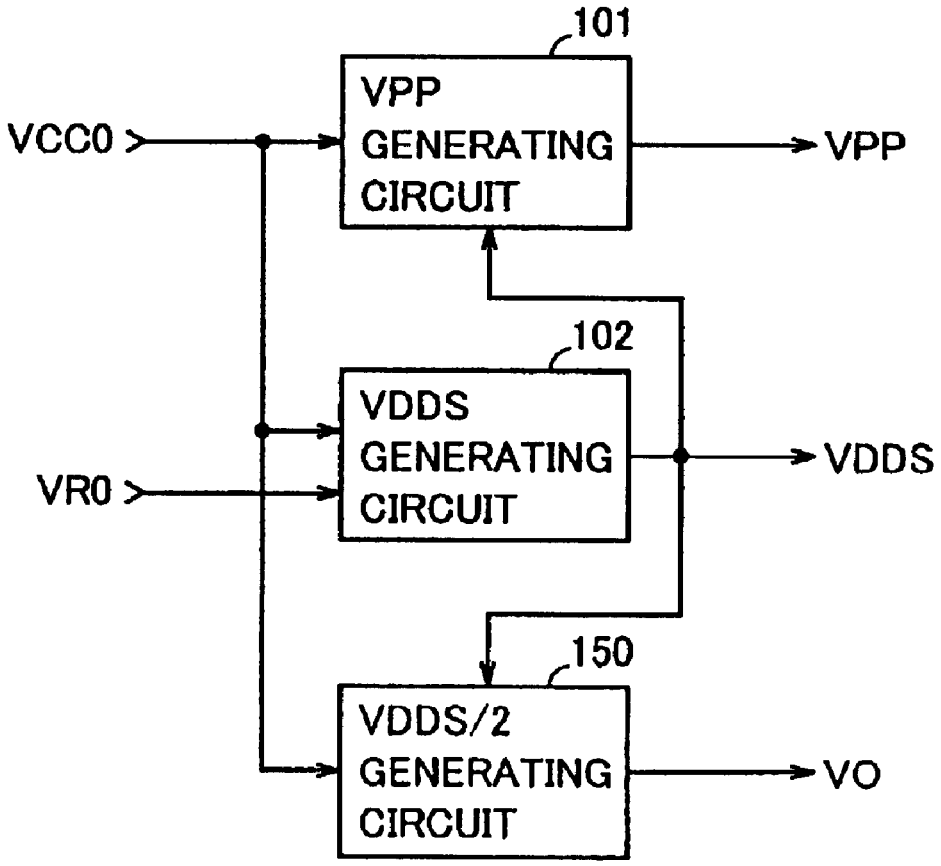
FIG. 20 is a block diagram for describing an effect of the third embodiment.
Figure 21:
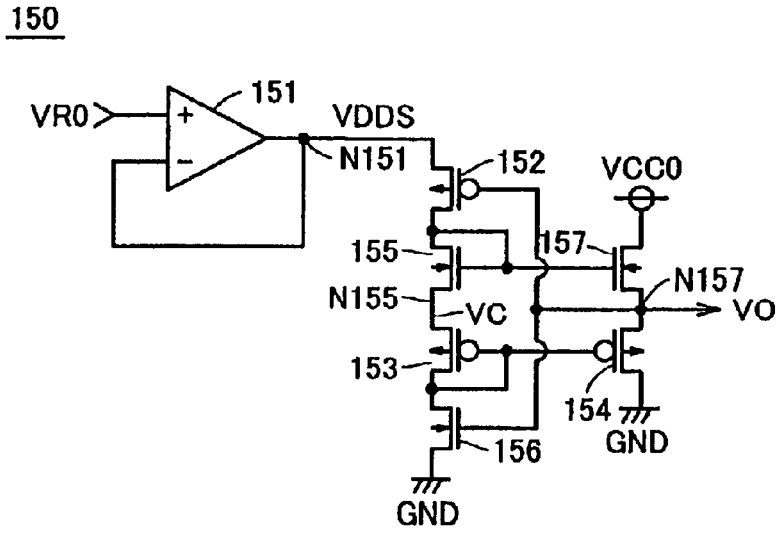
FIG.21 PRIOR ART
FIG. 21 is a circuit diagram showing a configuration of a conventional internal power supply potential generating circuit.
Figure 22:
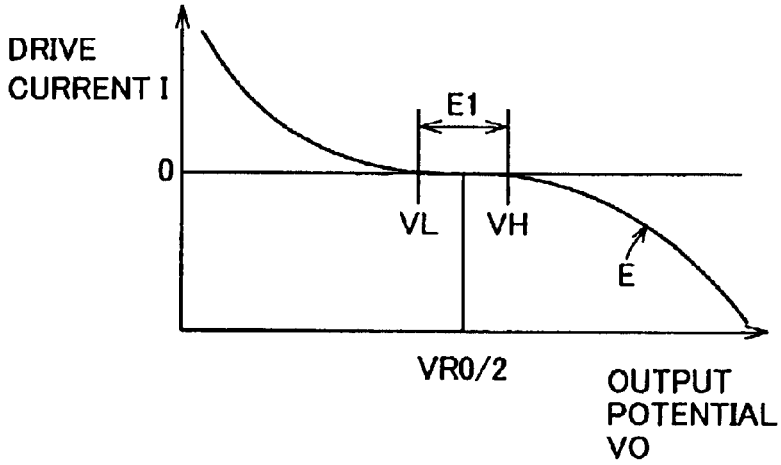
FIG.22 PRIOR ART
FIG. 22 is a graph showing an operation of the internal power supply potential generating circuit shown in FIG. 21.
Figure 23:
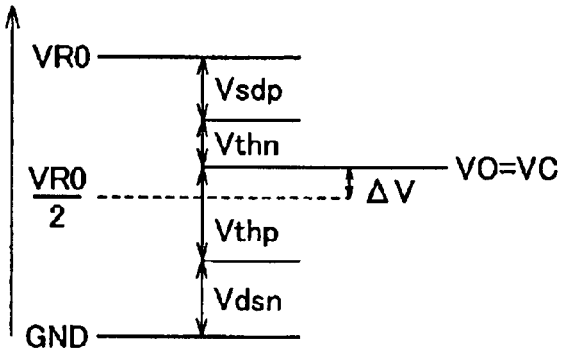
FIG.23 PRIOR ART
FIG. 23 is a view for describing a problematic point of a conventional internal power supply potential generating circuit.

Note that in a conventional art, as shown in FIG. 20, a potential VO=VDDS/2 1/2 times internal power supply potential VDDS for sense amplifier 112 was generated by VDDS generating circuit 150, which was an intermediate potential generating circuit. Therefore, as described in the section of description of the background art, it has been difficult to adjust VO to VR0/2 so as to coincide with each other. According to the third embodiment, however, VO can be adjusted so as to correctly coincide with VR/2, thereby enabling correct reading of a data signal.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A potential generating circuit in which charging and discharging of an output node are performed in order that a potential as said output node becomes a potential corresponding to a reference potential, comprising:

a first comparison circuit, including first and second transistors, input electrodes of which receive said reference potential and the potential at said output node, respectively, and outputting a first signal at a level corresponding to a potential difference between the potential at said output node and a lower limit potential lower than said reference potential by a first offset voltage;

a second comparison circuit including third and fourth transistors, input electrodes of which receive said reference potential and the potential at said output node, respectively, and outputting a second signal at a level corresponding to a potential difference between the potential at said output node and an upper limit potential higher than said reference potential by a second offset voltage; and a drive circuit, operating in response to said first and second signals front said first and second comparison circuits, and causing a current to flow into said output node when the potential at said output node is lower than said lower limit potential, while when the potential at said output node is higher than said upper limit potential, causing a current to flow out from said output node.

2. The potential generating circuit according to claim 1, wherein said first and second transistors are of a first conductive type and said third and fourth transistors are of a second conductive type, said first comparison circuit further includes:

a first current mirror circuit having fifth and sixth transistors of the second conductive type, connected between a lion at a first power supply potential and a first electrode of said first transistor, and between the line at said first power supply potential and a first electrode of said second transistor, respectively, and input electrodes of which are both connected to the first electrode of said first transistor, wherein a current of a value corresponding to a current flowing in said first transistor is caused to flow into a second electrode of said second transistor; and a first constant current source connected between a second electrode of said first transistor and a line at a second power supply potential, and between said second electrode of said second transistor and the line at the second power supply potential, wherein a ratio between sizes of said first and second transistors is smaller than a ratio between sizes of said fifth and sixth transistors, and said first signal is outputted from said first electrode of said second transistor, and said second comparison circuit further includes:

a second constant current source connected between the line at said fast power supply potential and the first electrode of said third transistor, and between the line at said first power supply potential and the first electrode of said fourth transistor; and a second current mirror circuit having seventh and eighth transistors of said first conductive type, connected between the line at said second power supply potential and a second electrode of said third transistor, and between the line at said second power supply potential and a second electrode of said fourth transistor, and input electrodes of which are both connected to the second electrode of said third transistor, wherein a current of a value corresponding to a current flowing in said third transistor is caused to flow out from the second electrode of said fourth transistor, wherein a ratio between sizes of said third and fourth transistors is smaller than a ratio between sizes of said seventh and eighth transistors, and said second signal is outputted from the second electrode of said fourth transistor.

3. The potential generating circuit according to claim 2, wherein said drive circuit includes:

a first inverter outputting an inverted signal of said first signal;

a second inverter outputting an inverted signal of said second signal;

a ninth transistor of the second conductive type, connected between the line at said first power supply potential and said output node, and an input electrode of which receives an output signal of said first inverter; and a tenth transistor of the first conductive type, connected between the line at said second power supply potential and said output node, and an input electrode of which receives an output signal of said second inverter.

4. The potential generating circuit according to claim 3, wherein said first inverter includes:

an eleventh transistor of the second conductive type, a first electrode of which is connected to the line at said first power supply potential, a second electrode of which is connected to the input electrode of said ninth transistor and an input electrode of which receives said first signal;

a twelfth transistor of the first conductive type, a first electrode of which is connected to the input electrode of said ninth transistor, and an input electrode of which receives said first signal; and a first current limiting element, connected between a second electrode of said twelfth transistor and the line at said second power supply potential, and limiting a current flowing in said twelfth transistor, and said second inverter includes:

a thirteenth transistor of the first conductive type, a first electrode of which is connected to the line at said second power supply potential, a second electrode of which is connected to the input electrode of said tenth transistor, and an input electrode of which receives said second signal;

a fourteenth transistor of the second conductive type, a first electrode of which is connected to the input electrode of said tenth transistor, and an input electrode of which receives said second signal; and a second current limiting element, connected between a second electrode of said fourteenth transistor and the line at said first power supply potential, and limiting a current flowing in said fourteenth transistor.

5. The potential generating circuit according to claim 4, wherein said first inverter further includes a first diode element, connected in series with said first current limiting element between the second electrode of said twelfth transistor and the line at said second power supply potential, and adjusting a threshold voltage of said first inverter and said second inverter further includes a second diode element, connected in series with said second current limiting element between the second electrode of said fourteenth transistor and the line at said first power supply potential, and adjusting a threshold voltage of said second inverter.

6. The potential generating circuit according to claim 3, wherein said drive circuit further includes a switching element, connected in series with said ninth transistor between the line at said first power supply potential and said output node, and becoming non-conductive when said tenth transistor is conductive.

7. The potential generating circuit according to claim 3, wherein said drive circuit further includes a logic circuit giving a logical sum signal of output signals of said first and second inverters to the input electrode of said ninth transistor.

8. The potential generating circuit according to claim 3, further comprising a step-down circuit, generating a third power supply potential lower than said first power supply potential, and a current drive ability of which increases when said ninth transistor is conductive, said ninth transistor being connected between a line at said third power supply potential and said output node.

9. The potential generating circuit according to claim 1, further comprising a potential dividing circuit dividing a prescribed potential to generate said reference potential.

10. The potential generating circuit according to claim 1, wherein said first and second transistors are of a first conductive type and said third and fourth transistors are of a second conductive type, wherein said first comparison circuit further includes:

a first current mirror circuit having fifth and sixth transistors of the second conductive type, connected between a line at a first power supply potential and a first electrode of said first transistor, and between the line at said first power supply potential and a first electrode of said second transistor, respectively, and input electrodes of which are both connected to the first electrode of said second transistor, wherein a current of a value corresponding to a current flowing in said second transistor is caused to flow into a second electrode of said transistor; and a first constant current source connected between said second electrode of said first transistor and a line at a second power supply potential and between a second electrode of said second transistor and a line at a second power supply potential, wherein a ratio between sizes of said first and second transistors is smaller than a ratio between sizes of said fifth and sixth transistors, and said first signal is outputted from the first electrode of said first transistor, and said second comparison circuit further includes:

a second constant current source connected between a first electrode of said third transistor and the line at said first power supply potential and between a first electrode of said fourth transistor and the line at said first power supply potential; and a second current mirror circuit having seventh and eighth transistors of said first conductive type, connected between the line at said second power supply potential and a second electrode of said third transistor, and between the line at said second power supply potential and a second electrode of said fourth transistor, and input electrodes of which are both connected to the second electrode of said fourth transistor, wherein a current of a value corresponding to a current flowing in said fourth transistor is caused to flow out from the second electrode of said third transistor, wherein a ratio between sizes of said third and fourth transistors is smaller than a ratio between sizes of said seventh and eighth transistors, and said second signal is outputted from the second electrode of said third transistor.

11. The potential generating circuit according to claim 10, wherein said drive circuit includes:

a ninth transistor of the second conductive type, connected between the line at said first power supply potential and said output node, and an input electrode of which receives said first signal; and a tenth transistor of the conductive type, connected between the line at said second power supply potential and said output node, and an input electrode of which receives said second signal.

* * * * *